US010803752B2

(12) United States Patent
Yagi

(10) Patent No.: US 10,803,752 B2
(45) Date of Patent: Oct. 13, 2020

(54) ROADSIDE UNIT AND VEHICLE

(71) Applicant: KYOCERA Corporation, Kyoto (JP)

(72) Inventor: Masahiro Yagi, Kawasaki (JP)

(73) Assignee: KYOCERA Corporation, Kyoto (JP)

( * ) Notice: Subject to any disclaimer, the term of this patent is extended or adjusted under 35 U.S.C. 154(b) by 0 days.

(21) Appl. No.: 16/655,337

(22) Filed: Oct. 17, 2019

(65) Prior Publication Data

US 2020/0047659 A1 Feb. 13, 2020

Related U.S. Application Data

(63) Continuation of application No. PCT/JP2018/015988, filed on Apr. 18, 2018.

(30) Foreign Application Priority Data

Apr. 26, 2017 (JP) ..... 2017-087389

(51) Int. Cl.
*G08G 1/16* (2006.01)
*G08G 1/0967* (2006.01)

(52) U.S. Cl.
CPC ..... *G08G 1/166* (2013.01); *G08G 1/096783* (2013.01); *G08G 1/164* (2013.01)

(58) Field of Classification Search
CPC ..... G08G 1/01; G08G 1/0116; G08G 1/052; G08G 1/16; G08G 1/162; G08G 1/164; G08G 1/166; G08G 1/096716; G08G 1/096725; G08G 1/096758; G08G 1/096783; G08G 1/096791; B60W 30/09; B60W 30/0956; B60W 50/14
See application file for complete search history.

(56) References Cited

U.S. PATENT DOCUMENTS

| | | | | |
|---|---|---|---|---|
| 9,286,796 | B2 * | 3/2016 | Ikeya | G08G 1/052 |
| 2017/0084177 | A1 * | 3/2017 | Matsuoka | G08G 1/096791 |
| 2017/0103265 | A1 * | 4/2017 | Channah | B64D 47/08 |

FOREIGN PATENT DOCUMENTS

| | | | |
|---|---|---|---|
| JP | 2004-341938 | A | 12/2004 |
| JP | 2005-251062 | A | 9/2005 |
| JP | 2010-108403 | A | 5/2010 |
| JP | 2011-164064 | A | 8/2011 |
| JP | 2014-215719 | A | 11/2014 |
| JP | 2015-064786 | A | 4/2015 |
| JP | 2017-059070 | A | 3/2017 |

* cited by examiner

*Primary Examiner* — Van T Trieu
(74) *Attorney, Agent, or Firm* — Studebaker & Brackett PC

(57) ABSTRACT

A roadside unit comprises a communication unit and a controller. The communication unit wirelessly communicates with a vehicle. The controller: (i) obtains size information indicating a size of the vehicle; (ii) determines, based on the size information, whether the size is larger than a reference value; and (iii) transmits predetermined information to the vehicle through the communication unit when determining that the size is larger than the reference value.

16 Claims, 10 Drawing Sheets

ROADSIDE UNIT AND VEHICLE

CROSS-REFERENCE TO RELATED APPLICATION

The present application is a continuation based on PCT Application No. PCT/JP2018/015988 filed on Apr. 18, 2018, which claims the benefit of Japanese Application No. 2017-087389 filed on Apr. 26, 2017. PCT Application No. PCT/JP2018/015988 is entitled "ROADSIDE DEVICE, CONTROL METHOD OF ROADSIDE DEVICE, VEHICLE, AND RECORDING MEDIUM", and Japanese Application No. 2017-087389 is entitled "ROADSIDE MACHINE, METHOD FOR CONTROLLING ROADSIDE MACHINE, AND CONTROL PROGRAM". The contents of which are incorporated by reference herein in their entirety.

FIELD

Embodiments of the present disclosure generally relate to a roadside unit and a vehicle.

BACKGROUND

For example, bridge structures such as pedestrian crossover bridges are sometimes built on roads. These bridge structures are built across the roads in a width direction. The roads also include narrow roads.

SUMMARY

A roadside unit is disclosed. In one embodiment, a roadside unit is installed in a traffic network comprising a first road and a second road. The first road is a road on which a vehicle larger than a reference value is permitted to travel. The second road is a road connected to the first road and on which travel of the vehicle larger than the reference value is restricted. The roadside unit comprises a communication unit and a controller. The communication unit wirelessly communicates with the vehicle. The controller: (i) obtains size information indicating a size of the vehicle; (ii) determines, based on the size information, whether the size is larger than the reference value; and (iii) transmits predetermined information to the vehicle through the communication unit when determining that the size is larger than the reference value.

DETAILED DESCRIPTION

Figure 1:
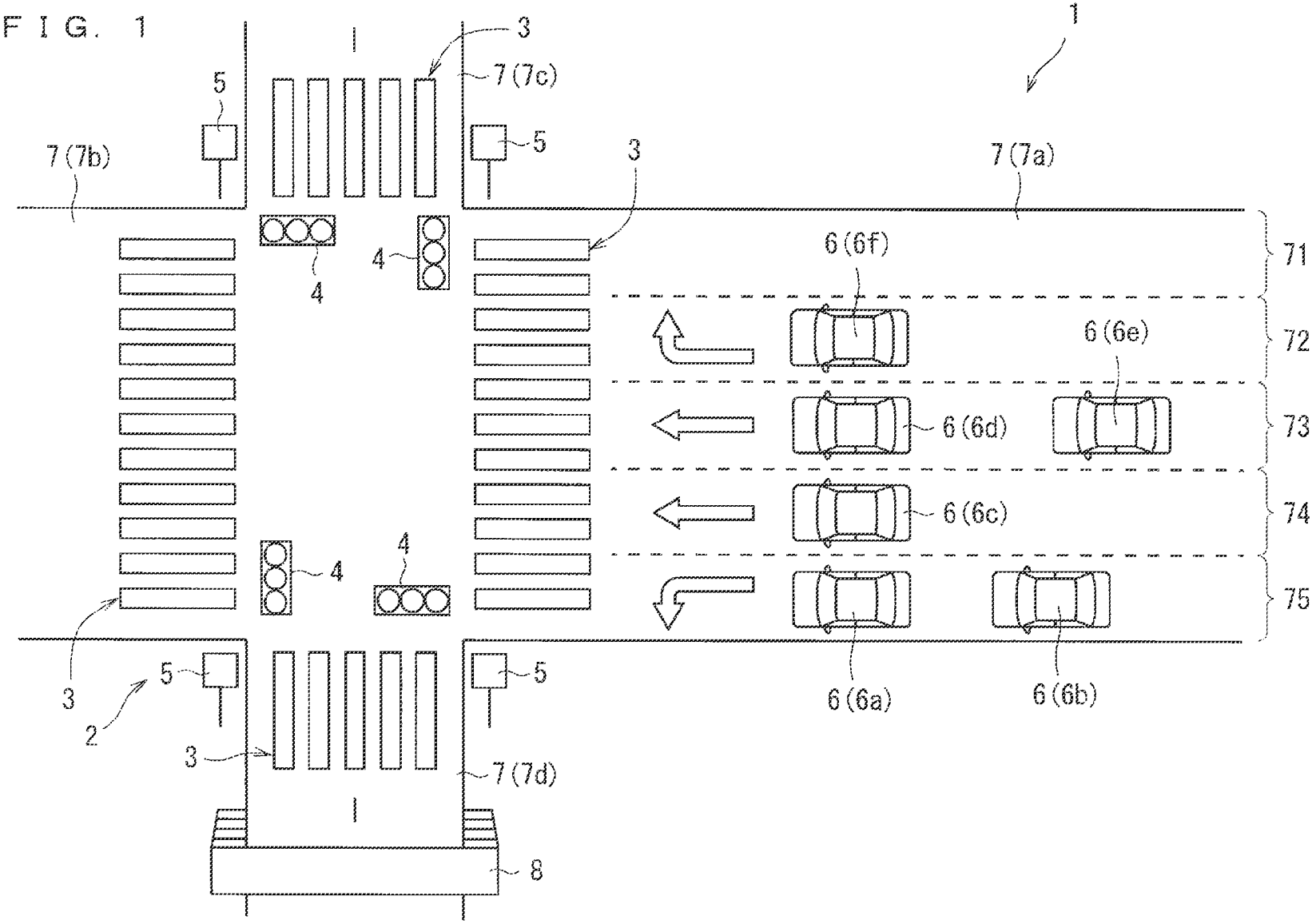
FIG. 1 schematically illustrates one example traffic communication system.

FIG. 1 schematically illustrates one example traffic communication system installed in a traffic network. A traffic communication system 1 is also referred to as an intelligent transport system (ITS), specifically, a driving safety support communication system. The traffic communication system 1 is also referred to as a driving safety support system or a driving safety support wireless system.

In the traffic communication system 1, roadside units 5 located at, for example, an intersection 2 and vehicles 6 such as automobiles traveling through a road 7 can wirelessly communicate with each other as illustrated in FIG. 1. Consequently, the roadside units 5 and the vehicles 6 can exchange information with each other. A plurality of the vehicles 6 can wirelessly communicate with each other. Consequently, the plurality of vehicles 6 can exchange information with each other. The communication between the roadside unit 5 and the vehicle 6 and the communication between the vehicles 6 are referred to as road-vehicle communications and inter-vehicle communications, respectively.

The roadside unit 5 can notify the vehicle 6 of, for example, information on lighting of traffic lights 4 and information on road restriction (e.g., information indicating a road with height restriction). The roadside units 5 can detect the vehicles 6 and pedestrians nearby. The roadside units 5 located at the intersection 2 can detect, for example, a pedestrian who crosses a pedestrian crossing 3. The roadside units 5 can notify the vehicles 6 of information on the vehicle 6 and the pedestrian that have been detected. The roadside unit 5 can notify the other vehicles 6 of information notified from the vehicle 6.

The vehicle 6 can notify the other vehicles 6 and the roadside units 5 of information on the position, the speed, and direction indicators (also referred to as blinkers) of its own vehicle 6. Then, the vehicle 6 can support driving safety of a driver through making various notifications including warnings to the driver based on the notified information. The vehicle 6 can make the various notifications to the driver using, for example, a speaker and a display.

As such, the traffic communication system 1 supports the driving safety of the drivers of the vehicles 6 through road-vehicle communications and inter-vehicle communications.

In the example of FIG. 1, four roads 7 are connected at the intersection 2. These four roads 7 may also be referred to as roads 7*a* to 7*d* hereinafter. The roads 7*a* and 7*b* are directly connected through the intersection 2, and the roads 7*c* and 7*d* are directly connected through the intersection 2. A pair of the roads 7*a* and 7*b* and a pair of the roads 7*c* and 7*d* intersect at right angles.

In the example of FIG. 1, the road 7*a* consists of a plurality of lanes 71 to 75. The lane 71 is a lane for the vehicles 6 to travel in a direction away from the intersection 2. The lanes 72 to 75 are lanes for the vehicles 6 to travel to the intersection 2. The lanes 72 to 75 are lanes with restrictions on traveling direction at the intersection 2. Specifically, for example, the lane 72 is an exclusive right-turn lane, the lanes 73 and 74 are exclusive straight-through lanes, and the lane 75 is an exclusive left-turn lane. Thus in the example of FIG. 1, the vehicle 6 traveling through the lane 72 turns right at the intersection 2 to proceed to the road 7*c*. The vehicles 6 traveling through the lanes 73 and 74 go straight through the intersection 2 to proceed to the road 7*b*. The vehicles 6 traveling through the lane 75 turn left at the intersection 2 to proceed to the road 7*d*. The lanes 72 to 74 are also regarded as lanes in which travel from the road 7*a* to the road 7*d* is prohibited. The lane 75 is also regarded as a lane in which travel from the road 7*a* to the road 7*d* is permitted.

The road 7*d* has a restriction section on the size (e.g., the height) of the vehicles 6. In the example of FIG. 1, the restriction section of the road 7*d* has a bridge structure 8. This bridge structure 8 is built across the road 7*d*. Here, when the vehicle 6 higher than the undersurface of the bridge structure 8 attempts to travel through the road 7*d*, the vehicle 6 collides with the bridge structure 8. A restriction value on the vehicle height is set to the road 7*d*. A road sign indicating this restriction value is placed near the road 7*d* or at the bridge structure 8 to show the driver the restriction value.

However, for example, when the vehicle 6 loads goods, the driver may wrongly recognize the height of the vehicle 6. Alternatively, for example, when the driver drives the vehicle 6 different from the vehicle that the driver normally drives, the driver may wrongly recognize the vehicle height. Here, when the vehicle 6 travels through the restriction section, the vehicle 6 may collide with the bridge structure 8. This embodiment aims at reducing such a collision.

In the example of FIG. 1, the roads 7*a* to 7*c* have no restriction section. Thus, even the vehicle 6 larger than the restriction value of the road 7*d* can travel through the roads 7*a* to 7*c*.

Figure 2:
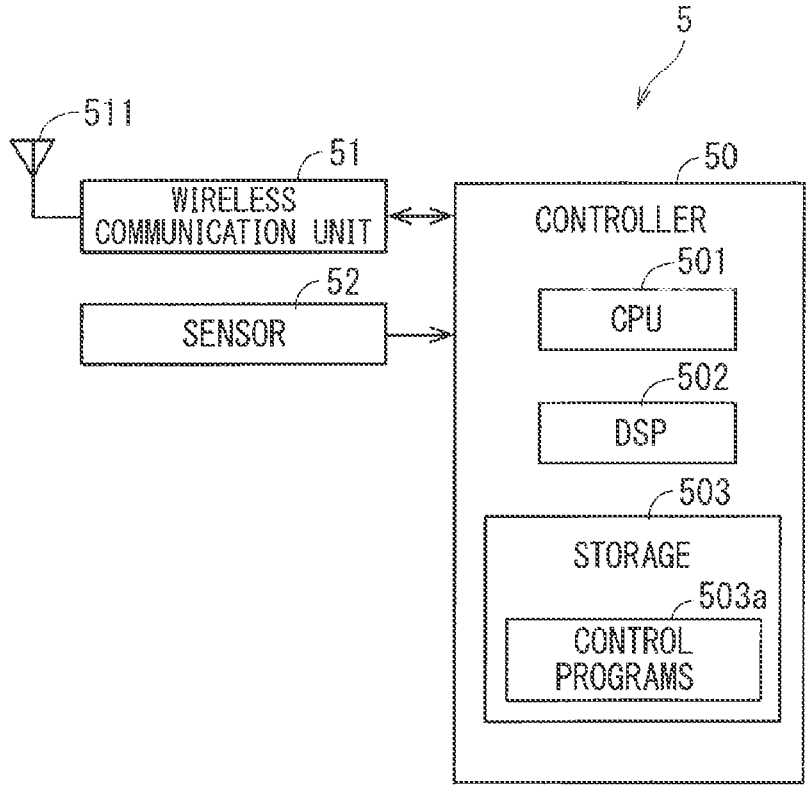
FIG. 2 illustrates a block diagram schematically showing one example roadside unit.

FIG. 2 illustrates a block diagram schematically showing one example electrical configuration of the roadside unit 5. The roadside unit 5 comprises a controller 50, a wireless communication unit 51, and a sensor 52.

The controller 50 can manage the overall operations of the roadside unit 5. The controller 50 is also referred to as a control circuit. The controller 50 comprises at least one processor for providing control and processing capability to implement various functions as will be further described in detail below.

In accordance with various embodiments, the at least one processor may be implemented as a single integrated circuit (IC) or as multiple communicatively coupled ICs and/or discrete circuits. The at least one processor can be implemented in accordance with various known technologies.

In one embodiment, the processor comprises, for example, one or more circuits or units configured to perform one or more data computing procedures or processes by executing instructions stored in an associated memory. In the other embodiments, the processor may be implemented as firmware (e.g., discrete logic components) configured to perform one or more data computing procedures or processes.

In accordance with the various embodiments, the processor may comprise one or more processors, controllers, microprocessors, microcontrollers, application specific integrated circuits (ASICs), digital signal processors, programmable logic devices, field programmable gate arrays, any combination of these devices or structures, or a combination of the other known devices and structures, to implement the functions to be described hereinafter.

In this example, the controller 50 comprises a central processing unit (CPU) 501, a digital signal processor (DSP) 502, and storage 503. The storage 503 comprises a non-transitory recording medium that can be read by the CPU 501 and the DSP 502, such as a read only memory (ROM) and a random access memory (RAM). The ROM in the storage 503 is, for example, a flash ROM (flash memory) that is a non-volatile memory. For example, a plurality of control programs 503*a* for controlling the roadside unit 5 are stored in the storage 503. The CPU 501 and the DSP 502 execute the various control programs 503*a* in the storage 503 to implement the various functions of the controller 50.

All or part of the functions of the controller 50 may be implemented by a hardware circuit that does not require software for implementing the functions. The storage 503 may comprise a non-transitory computer-readable recording medium other than the ROM and the RAM. The storage 503 may comprise, for example, a compact hard disk drive and a solid-state drive (SSD).

The roadside unit 5 may comprise storage different from the storage 503. The aforementioned information to be stored in the storage 503 or information to be stored in the storage 503 which will be described below may be stored in the different storage.

The wireless communication unit (communication circuit) 51 comprises an antenna 511. The wireless communication unit 51 can wireless communicate via the antenna 511. The controller 50 controls the wireless communication of the wireless communication unit 51. The wireless communication unit 51 can directly and wirelessly communicate with the vehicle 6. For example, the wireless communication unit 51 can communicate with the vehicle 6 using a communication bandwidth of 9 MHz in the 760 MHz band.

The wireless communication unit 51 performs various processes, for example, an amplification process on a signal received via the antenna 511 to output the resulting reception signal to the controller 50. The controller 50 performs various processes on the reception signal to be input, to obtain information contained in the reception signal. The controller 50 outputs a transmission signal containing the information to the wireless communication unit 51. The wireless communication unit 51 performs the various processes, for example, the amplification process on the transmission signal to be input, to wirelessly transmit the resulting transmission signal from the antenna 511.

When the other roadside units 5 are installed within communicating distance of the wireless communication unit 51, the wireless communication unit 51 may wirelessly communicate with the other roadside units 5. Alternatively, the wireless communication unit 51 may be connected to the other roadside units 5 via wires to communicate with the other roadside units 5 via the wires.

The sensor 52 can detect the size (e.g., the height) of the vehicle 6 traveling through the roads 7, and output the detected value to the controller 50 as size information (e.g., vehicle height information). For example, the sensor 52 is installed so that its detection target range covers at least the lanes 72 to 75 (FIG. 1). Consequently, the sensor 52 can detect the size of the vehicle 6 traveling through the road 7*a* toward the intersection 2. The sensor 52 may be installed so that its detection target range covers nor only the road 7*a* but also the other roads 7*b* to 7*d*. Alternatively, a plurality of sensors 52 each covering one of the roads 7*a* to 7*b* in the detection target range may be installed.

Assuming as one example that the sensor 52 covering the lanes 72 to 75 in its detection target range is used, description will be given focusing on the vehicles 6 traveling through the roads 72 to 75 for simplification. In other words, assume herein that the sensor 52 detects the sizes of the vehicles 6 traveling through the roads 72 to 75. Furthermore, an example mainly using the vehicle height as the size of the vehicle will be hereinafter described.

The sensor 52 comprises, for example, a depth image sensor. The depth image sensor comprises a light source and a light receiver. The light source emits light (e.g., amplitude modulated light) from above the vicinity of the intersection 2 to the detection target range. The light receiver comprises, for example, a plurality of photoreceptors arranged in a grid pattern. Each of the photoreceptors receives the light reflected from an object in the detection target range. The depth image sensor detects a distance from the depth image sensor to the object, based on the time from emission of the light from the light source to reception of the reflected light by each of the photoreceptors. Such a detection method is referred to as the time-of-flight (TOF) method. The depth image sensor can also generate a three-dimensional image indicating the distance for each pixel (the photoreceptor).

The sensor 52 can identify the vehicle 6 contained in the three-dimensional image through image analysis on the three-dimensional image. Although any method may be used as this method, one of the examples will be simply described. For example, a feature volume (a three-dimensional feature volume) is retrieved from the three-dimensional image, and the vehicle 6 and the others are distinguished from one another based on the feature volume. Machine learning, for example, Support Vector Machine (SVM) may be used for this distinction. Since the vehicle 6 whose rear portion is contained in the three-dimensional image travels in a direction away from the intersection 2, the sensor 52 need not detect this vehicle 6.

Figure 3:
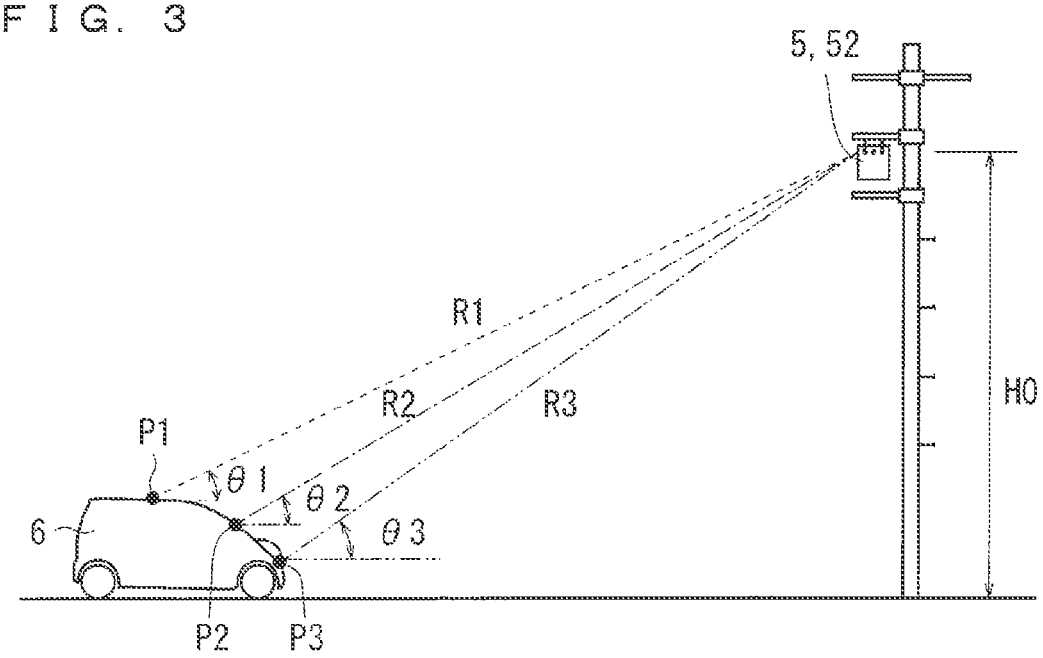
FIG. 3 schematically illustrates one example of a vehicle and a sensor.

FIG. 3 schematically illustrates one example of the vehicle 6 and the sensor 52. The three-dimensional image contains information indicating a distance Rn (n is a natural number: distances R1 to R3 in FIG. 1) between the sensor 52 and a point Pn on the surface of the vehicle 6 (n is a natural number: points P1 to P3 in FIG. 1). An angle θn (n is a natural number: angles θ1 to θ3 in FIG. 1) formed between the horizontal plane and a straight line connecting the point Pn to the sensor 52 is predetermined according to the installed direction of the sensor 52. Denoting the installed height of the sensor 52 as HO, the height Hn of each point Pn is found from the following Equation.

$$Hn=H0-Rn\cdot\sin\theta n \quad (1)$$

The sensor 52 calculates the heights Hn of the points Pn of the vehicle 6 based on Equation (1), and calculates the highest value among these heights Hn as the height of the vehicle 6.

At least a part of the image analysis functions (including computation for detecting the vehicle height) may be incorporated into the controller 50. In such a case, the depth image sensor and one functional unit (the image analysis functions) of the controller 50 form the sensor 52. Similarly, the other processing functions of the sensor 52 to be described later may be incorporated into the controller 50.

For example, the technology described in Patent Document 1 may be applied to detection of the height of the vehicle 6 by the sensor 52.

The controller 50 can determine whether the height of the vehicle 6 detected by the sensor 52 is larger than a reference value. The reference value is, for example, a reference value on the vehicle height. In the example of FIG. 1, the reference value may be a restriction value on the vehicle height that is set to a restriction section of the road 7*d* (e.g., the bridge structure 8). This reference value may be stored in, for example, the storage 503. When determining that the height of the vehicle 6 is larger than the reference value, the controller 50 can incorporate predetermined warning information into a signal and transmit the signal to the vehicle 6 through the wireless communication unit 51.

Figure 4:
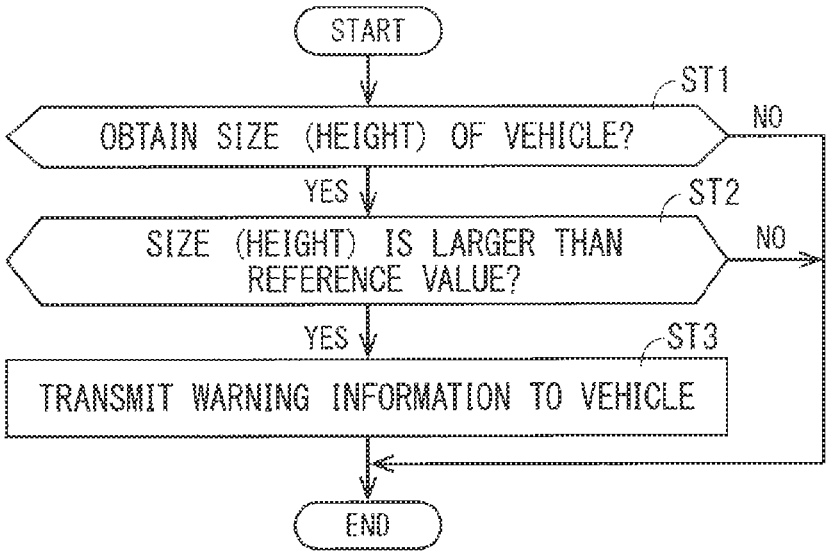
FIG. 4 illustrates a flowchart showing one example of operations of the roadside unit.

FIG. 4 illustrates a flowchart showing one example of the operations of the roadside unit 5. A series of these processes is executed, for example, at predetermined time intervals. First in Step ST1, the controller 50 determines whether the vehicle height information of the vehicle 6 has been obtained. In the absence of the vehicle 6 in the detection target range of the sensor 52, the sensor 52 neither detects the height of the vehicle 6 nor obtains the vehicle height information. When determining that the controller 50 does not obtain the vehicle height information, the controller 50 ends the processes.

In the presence of the vehicle 6 in the detection target range, the sensor 52 detects the height of the vehicle 6, and outputs the detected value to the controller 50 as the vehicle height information. Thus, the controller 50 obtains the vehicle height information. When determining that the controller 50 has obtained the vehicle height information, the controller 50 determines whether the height of the vehicle 6 detected by the sensor 52 is larger than the reference value in Step ST2. When determining that the height of the vehicle 6 is smaller than the reference value, the controller 50 ends the processes. When determining that the height of the vehicle 6 is larger than the reference value, the controller 50 incorporates the warning information into a signal and transmits the signal to the vehicle 6 through the wireless communication unit 51 in Step ST3. Here, the controller 50 may transmit the signal only to the vehicle 6 whose height is larger than the reference value. The specific method will be described later in detail.

As described above, the roadside unit 5 transmits the warning information to the vehicle 6 when the height of the vehicle 6 exceeds the reference value that is based on the restriction value of the vehicle height which is set to the road 7*d*.

Figure 5:
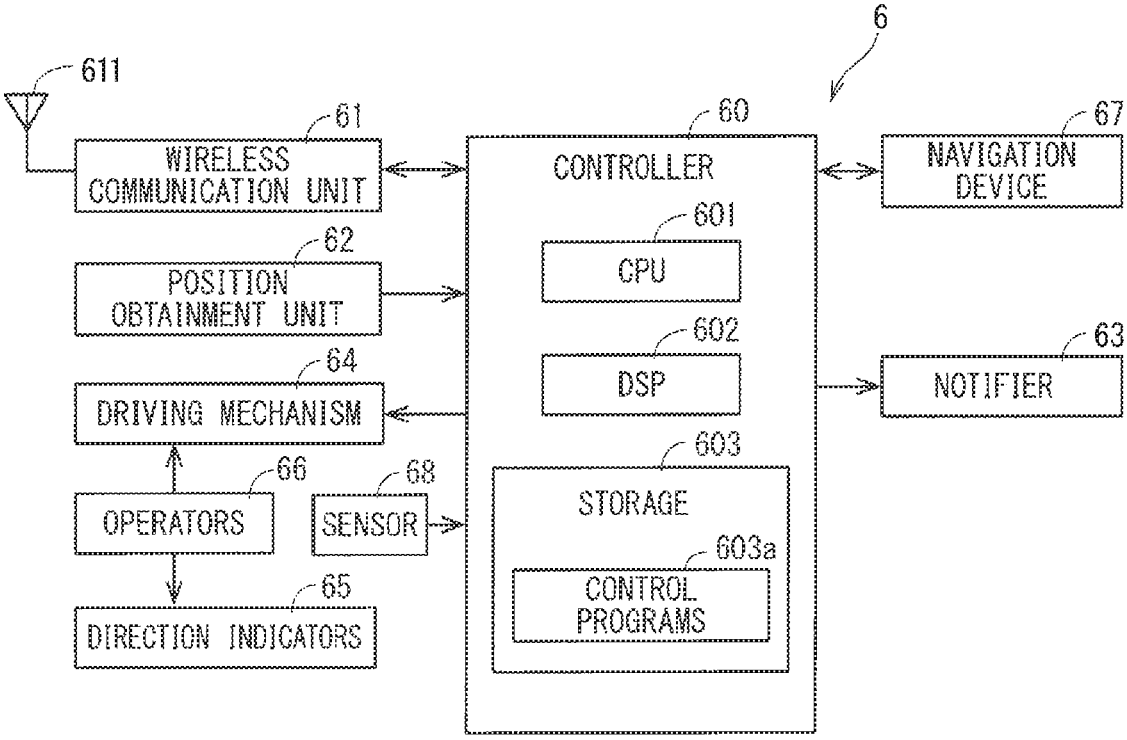
FIG. 5 illustrates a block diagram schematically showing one example configuration of the vehicle.

FIG. 5 illustrates a block diagram schematically showing one example configuration of the vehicle 6. The vehicle 6 comprises a controller 60, a wireless communication unit 61, a position obtainment unit 62, a notifier 63, a driving mechanism 64, direction indicators 65, and operators 66.

The controller 60 can manage the overall operations of the vehicle 6. Since the hardware configuration of the controller 60 is the same as that of the controller 50, the repeated description will be avoided. In the example of FIG. 5, the controller 60 comprises a CPU 601, a DSP 602, and storage 603 in which control programs 603*a* are stored.

The wireless communication unit (communication circuit) 61 comprises an antenna 611. The wireless communication unit 61 can wireless communicate via the antenna 611. The controller 60 controls the wireless communication of the wireless communication unit 61. The wireless communication unit 61 can directly and wirelessly communicate with the roadside units 5 and the other vehicles 6. For example, the wireless communication unit 61 can communicate with the roadside units 5 and the other vehicles 6 using the communication bandwidth of 9 MHz in the 760 MHz band.

The position obtainment unit 62 can obtain position information indicating a position of the vehicle 6, and output this position information to the controller 60. For example, the position obtainment unit 62 can receive a satellite signal to be transmitted from a positioning satellite. The position obtainment unit 62 generates the position information of the vehicle 6 based on the received satellite signal. This position information contains, for example, the latitude and longitude indicating the position of the vehicle 6. The controller 60 can operate the position obtainment unit 62 and stop the operations thereof.

The position obtainment unit 62 comprises, for example, a GPS receiver, and can receive a wireless signal from a positioning satellite of the Global Positioning System (GPS). The position obtainment unit 62 calculates a current position of the vehicle 6, for example, in latitude and longitude based on the received wireless signal, and outputs the position information containing the calculated latitude and longitude to the controller 60.

The position obtainment unit 62 may find the position information of the vehicle 6, based on a signal from a positioning satellite of the Global Navigation Satellite System (GNSS) other than the GPS. The position obtainment unit 62 may find the position information of the vehicle 6 based on a signal from a positioning satellite of, for example, the Global Navigation Satellite System (GLONASS), the Indian Regional Navigational Satellite System (IRNSS), the COMPASS, the Galileo, or the Quasi-Zenith Satellite System (QZSS).

The position obtainment unit 62 may comprise a camera. Specifically, the position obtainment unit 62 captures a landscape image containing a building, a facility, a traffic sign, advertising signage, a placard, or a plant around the vehicle 6. The position obtainment unit 62 may perform image analysis on the obtained landscape image, and obtain the current position of the vehicle 6 based on the features identified through the image analysis. For example, the vehicle 6 may query, through the wireless communication unit 61, a cloud server about a place matching the features identified through the image analysis. The cloud server manages, in association with one another, the position information such as the latitude and longitude and features of the landscape image in a place corresponding to the position information. The vehicle 6 may receive, from the cloud server, the position information corresponding to the place matching the features identified through the image analysis. The vehicle 6 may determine the current position based on the position information received from the cloud server.

The notifier 63 can notify the driver based on the control of the controller 60. The notifier 63 comprises, for example, a display and a sound output unit (e.g., a speaker). The notifier 63 notifies the driver of various pieces of information by means of, for example, display and sound.

The driving mechanism 64 is a mechanism on the driving of the vehicle 6, and comprises wheels, and mechanisms such as a rotation mechanism (comprising a motor and an engine) for rotating the wheels and a direction variable mechanism (comprising a steering system) for turning the wheels.

The direction indicators 65 are devices for notifying an object around the vehicle 6 of a traveling direction, and are also referred to as blinkers. The direction indicators 65 comprise light emitters (e.g., light bulbs or light emitting diodes (LEDs)) which are mounted on the left end portion and the right end portion in each of the front portion and the rear portion of the vehicle 6. The direction indicators 65 cause, for example, only the light emitters in the left end portions to emit light (e.g., blink) to advertise a schedule in which the vehicle 6 will turn left. Similarly, the direction indicators 65 cause, for example, only the light emitters in the right end portions to emit light (blink) to advertise a schedule in which the vehicle 6 will turn right.

The operators 66 are devices that receive operations on driving of the vehicle 6 to be performed by the driver. The operators 66 comprise, for example, an operator for reducing the rotational speed of the wheels (e.g., a brake pedal), an operator for increasing the rotational speed (e.g., an accelerator pedal), and an operator for turning the wheels (e.g., a steering wheel). The operators 66 also comprise an operator for operating the direction indicators 65 (e.g., a blinker lever).

In the example of FIG. 5, the vehicle 6 comprises a navigation device 67. The navigation device 67 has a function of guiding a route to a destination. For example, the driver inputs this destination into the navigation device 67. The navigation device 67 generates, based on the map information, route information indicating a route from the position of the vehicle 6 which is obtained by the position obtainment unit 62 to the destination. This route information indicates a path through which the vehicle 6 will travel (planned path).

The map information contains road data consisting of link data and node data. The node data is data indicating points at each of which a road intersects, branches, and merges. The link data is data indicating road sections connected between nodes. The link data contains information on, for example, an identification number for identifying a road in each section, a road length indicating a length of the road in the section, coordinates of a start point and an end point of the road in the section (e.g., the latitude and longitude), a type of the road (e.g., national road), the number of lanes, the presence or absence of the exclusive left-turn lane and the exclusive right-turn lane, and the number of the exclusive lanes. The node data contains information on, for example, an identification number for identifying a node, coordinates of the node, and an identification number of a road connected to the node. This map information is stored in storage of the navigation device 67. This map information may also contain information indicating a position and a restriction value of a restriction section of the road 7*d* (the bridge structure 8).

The navigation device 67 may generate, based on the map information, the route information indicating a plurality of routes. The driver may enter an input for selecting one of the routes into the navigation device 67. The navigation device 67 gives guidance based on the route information indicating the route selected by the driver. For example, the navigation device 67 may display the map information on the display, and also display the route to the destination on the map. When the vehicle 6 approaches an intersection, the navigation device 67 may audibly output, to the driver, a direction in which the vehicle 6 should proceed at the intersection.

These display and sound output may be performed using the configuration of the notifier 63.

In the example of FIG. 5, the vehicle 6 comprises a sensor 68. This sensor 68 can detect an amount of operations on the operators 66 that are performed by the driver, and output the detection result to the controller 60. For example, the sensor 68 may detect an amount of operations on the operator for adjusting the orientation of the wheels (an amount of revolutions of the steering wheel). An optical or magnetic rotary encoder can be adopted as this sensor 68 which is mounted on a steering shaft extending from the steering wheel and which detects an amount of revolutions of the steering shaft.

The controller 60 of the vehicle 6 can transmit a signal to surrounding objects through the wireless communication unit 61. For example, the controller 60 incorporates, into a signal, the position information of the vehicle 6 obtained by the position obtainment unit 62, and transmits this signal to the surrounding objects in point-to-multipoint communication (e.g., multicast). Consequently, the vehicle 6 can notify the other devices (the roadside units 5 and the other vehicles 6) of the position of its own vehicle.

The controller 60 can receive signals from the roadside units 5 and the other vehicles 6 through the wireless communication unit 61. For example, the controller 60 can receive a signal from the roadside unit 5, and retrieve warning information contained in this signal. Hereinafter, reception of a signal containing information may be simply described as reception of information, and transmission of a signal containing information may be simply described as transmission of information.

Upon receipt of the warning information, the controller 60 may cause the notifier 63 to notify the warning information. Consequently, the notifier 63 can notify the driver that the height of the vehicle 6 is larger than the restriction value of the road 7*d*.

Figure 6:
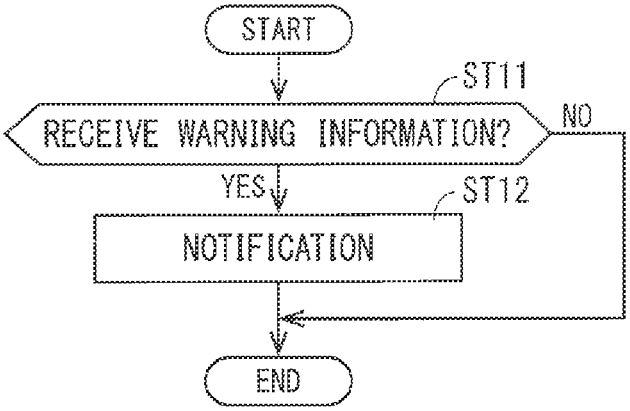
FIG. 6 illustrates a flowchart showing one example of operations of the vehicle.

FIG. 6 illustrates a flowchart showing one example of the operations of the vehicle 6. A series of these processes may be executed, for example, at predetermined time intervals. First in Step ST11, the controller 60 determines whether the warning information has been received from the roadside unit 5. When determining no reception of the warning information, the controller 60 ends the processes. When determining the reception of the warning information, the controller 60 causes the notifier 63 to notify the warning information in Step ST12. For example, the notifier 63 notifies, audibly or by means of display, the driver that the height of the vehicle 6 is larger than the restriction value of the road 7*d*.

The driver can recognize that the height of the vehicle 6 is larger than the restriction value of the road 7*d* through this notification. Consequently, the driver can take an appropriate action. Specifically, the driver can drive the vehicle 6 while avoiding the restriction section of the road 7*d* (here, the bridge structure 8).

In the aforementioned example, the controller 60 of the vehicle 6 causes the notifier 63 to notify the warning information. As a replacement for this notification process or together with the notification process, the controller 60 may perform a process of controlling the driving mechanism 64 so that the controller 60 restricts the vehicle 6 from driving to the restriction section. Specifically, for example, when the vehicle 6 approaches a restriction section, the controller 60 may decelerate or stop the vehicle 6 before the vehicle 6 enters the restriction section.

Figure 7:
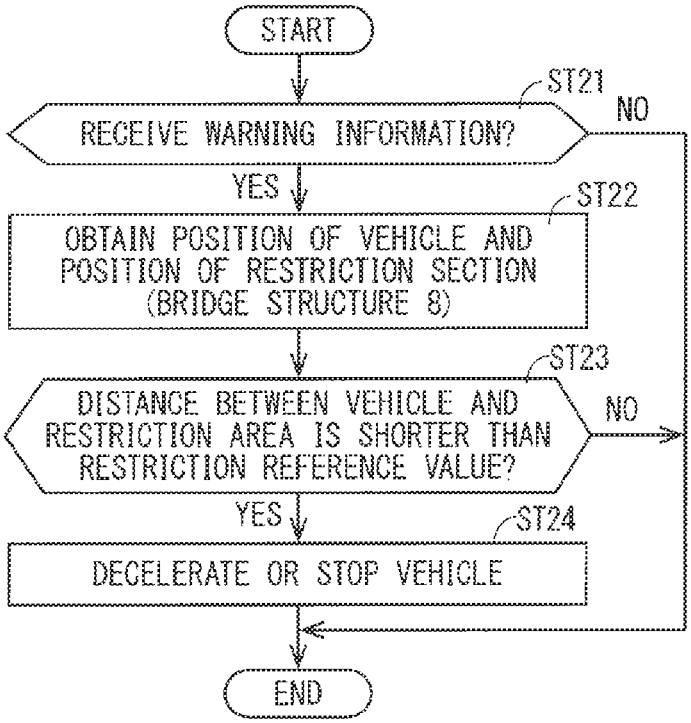
FIG. 7 illustrates a flowchart showing one example of the operations of the vehicle.

FIG. 7 illustrates a flowchart showing one example of the operations of the vehicle 6. A series of these processes may be executed, for example, at predetermined time intervals. First in Step ST21, the controller 60 determines whether the warning information has been received from the roadside unit 5. When determining no reception of the warning information, the controller 60 ends the processes. When determining the reception of the warning information, the controller 60 obtains the position information of the vehicle 6 from the position obtainment unit 62, and obtains the position information of a restriction section based on the map information in Step ST22. The controller 60 may receive the position information of the restriction section from the roadside unit 5. In other words, the roadside unit 5 may transmit, to the vehicle 6, not only the warning information but also the position information indicating the position of the restriction section.

Next in Step ST23, the controller 60 determines whether a distance (the minimum distance) between the vehicle 6 and the restriction section is shorter than a predetermined restriction reference value. For example, this restriction reference value may be preset and stored in the storage 603. In the example of FIG. 1, the restriction reference value may be set shorter than a distance between the intersection 2 and the bridge structure 8. When determining that the distance is longer than the restriction reference value, the controller 60 ends the processes. When determining that the distance is shorter than the restriction reference value, the controller 60 controls the driving mechanism 64 so that the vehicle 6 is decelerated or stopped in Step ST24. Here, the controller 60 may control the driving mechanism 64 so that the vehicle 6 stops at an edge of the road 7*d*.

This can restrain the entry of the vehicle 6 into the restriction section, and a collision between the vehicle 6 and the bridge structure 8. In other words, it is possible to restrain a vehicle larger than a reference value from traveling into a road with restriction of the driving of such a vehicle.

Next, a method for the roadside unit 5 to communicate with a particular one of the vehicles 6 will be described.

For example, the controller 50 of the roadside unit 5 may set, based on information from the plurality of the vehicles 6, address information for communication with each of the plurality of the vehicles 6. Furthermore, the controller 50 obtains the vehicle height information of the vehicle 6 from the sensor 52. Thus, transmission of the warning information only to the vehicle 6 whose height is larger than a reference value requires associating this address information with the vehicle height information for each of the vehicles 6. Here, a method for associating the address information with the vehicle height information using the position information of the vehicle 6 will be described as one example.

Before describing this method, one example method for setting the address information will be described. For example, the controller 50 may receive the identification information of the vehicle 6 from the vehicle 6, and set this identification information as the address information for communication. Information on, for example, the vehicle model (including the shape and the color), the vehicle registration plate (i.e., the license plate), or the serial number can be adopted as the identification information for identifying the vehicle 6. For example, FIG. 1 illustrates vehicles 6*a* to 6*f* as the plurality of vehicles 6 passing through the road 7*a* toward the intersection 2. The controller 50 of the roadside unit 5 sets pieces of the identification information received from the vehicles 6*a* to 6*f* as pieces of the address information Da to Df of the vehicles 6*a* to 6*f*, respectively.

The controller 50 incorporates, into a signal, the address information of the vehicle 6 to be a transmission destination, and transmits the signal through the wireless communication unit 51. For example, when transmitting the signal to the vehicle 6*a*, the controller 50 incorporates the address information Da into a signal to transmit the signal.

Upon receipt of a signal from the roadside unit 5, the controller 60 of the vehicle 6 retrieves the address information contained in this signal, and determines, based on the address information, whether the signal contains information addressed to its own vehicle. Specifically, when the received address information coincides with the identification information stored in the storage 603, the controller 60 determines that this signal is a signal addressed to its own vehicle. Thus, the controller 60 of the vehicle 6*a* determines that this signal is the signal addressed to its own vehicle when the signal contains the address information Da, and determines that this signal is not the signal addressed to its own vehicle when the signal contains the other pieces of address information Db to Df.

This series of operations enables the roadside unit 5 to transmit the signal to a particular one of the vehicles 6.

Next, a method for associating the address information of the vehicle 6 with the vehicle height information from the sensor 52 for each of the vehicles 6 will be described. Here, the address information is associated with the vehicle height information using the position information of the vehicle 6.

The sensor 52 can, for example, detect not only the height of the vehicle 6 but also its position, and output the detected value to the controller 50 as the position information. The sensor 52 can, for example, detect a position of a vehicle through image analysis. Although any method may be used as a method for detecting the position through image analysis, one of the examples will be simply described. The sensor 52 can, for example, identify the vehicle 6 through image analysis to identify the position of the vehicle 6 in the three-dimensional image as a result of this identification. The sensor 52 may, for example, perform a predetermined coordinate transformation on this three-dimensional image to generate a three-dimensional image obtained by vertically capturing an image of the vehicle 6 from above (i.e., a bird's-eye view image). The association between the position of each pixel in this bird's-eye view image and the actual position (e.g., the latitude and longitude) is preset. The sensor 52 finds the actual position of the vehicle 6, based on the association and the position of the vehicle 6 in this bird's-eye view image.

In the presence of a plurality of the vehicles 6 in the detection target range, the sensor 52 detects the height and the position for each of the vehicles 6. Then, the sensor 52 outputs, to the controller 50, the vehicle information and the position information that are associated for each of the vehicles 6. Specifically, vehicle height information Ha and position information Pa1 of the vehicle 6*a* are associated with each other. The same holds true for pieces of vehicle height information Hb to Hf and pieces of position information Pb1 to Pf1 of the vehicles 6*b* to 6*f*, respectively.

The controller 50 can receive, from the vehicle 6 through the wireless communication unit 51, not only the identification information of the vehicle 6 but also the position information obtained by the position obtainment unit 62 of the vehicle 6. Thus, the controller 50 can associate the address information (the identification information herein) and the position information of the vehicle 6 with each other. The controller 50 associates, for example, the address information Da and the position information Pa2 of the vehicle 6*a* with each other. The same holds true for pieces of address information Db to Df and the pieces of position information Pb2 to Pf2 of the vehicles 6*b* to 6*f*, respectively.

The position of the vehicle 6 detected by the sensor 52 of the roadside unit 5 may slightly differ from the position of the vehicle 6 obtained by the position obtainment unit 62 of the vehicle 6. This difference may be created due to, for example, the detection timing or the detection error. Thus, a numeral "1" is appended to a letter symbol representing the position information output from the sensor 52, whereas a numeral "2" is appended to a letter symbol representing the position information generated by the position obtainment unit 62. For example, the position information Pa1 denotes the position information of the vehicle 6*a* detected by the sensor 52, and the position information Pa2 denotes the position information of the vehicle 6*a* obtained by the position obtainment unit 62.

Since the address information and the vehicle height information corresponding to the same position are information corresponding to the same vehicle 6, the controller 50 can associate the address information and the vehicle height information of the same vehicle 6 with each other based on the position information. Specifically, for example, the controller 50 first calculates a difference between the position denoted by each piece of the position information Pa1 to Pf1 from the sensor 52 and the position indicated by the position information Pa2 from the vehicle 6, and identifies the position information Pa1 with the smallest difference. In other words, the controller 50 identifies the position information Pa1 that is the closest to the position information Pa2. Then, the controller 50 associates the vehicle height information Ha corresponding to the position information Pa1, with the address information Da corresponding to the position information Pa2. Similarly, the vehicle height information and the address information are associated with each other, based on the position information for the other vehicles 6. The following table is a table indicating one example association between the address information, the position information from the vehicle 6, and the vehicle height information and the position information from the sensor 52.

TABLE 1

| | | RECEIVED | DETECTED BY SENSOR | |
|---|---|---|---|---|
| VEHICLE | ADDRESS INFORMATION | FROM VEHICLE POSITION | POSITION | SIZE (VEHICLE HEIGHT) |
| 6a | Da | Pa2 | Pa1 | Ha |
| 6b | Db | Pb2 | Pb1 | Hb |
| 6c | Dc | Pc2 | Pc1 | Hc |
| 6d | Dd | Pd2 | Pd1 | Hd |
| 6e | De | Pe2 | Pe1 | He |
| 6f | Df | Pf2 | Pf1 | Hf |

Figure 8:
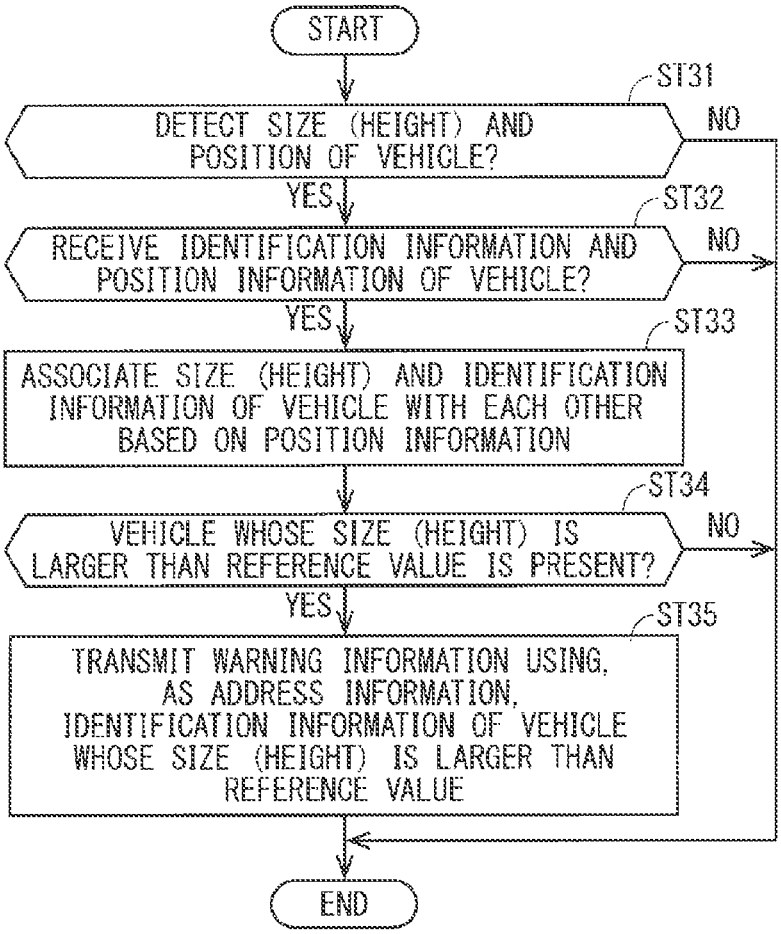
FIG. 8 illustrates a flowchart showing one example of the operations of the roadside unit.

FIG. 8 illustrates a flowchart showing one example of the operations of the roadside unit 5. A series of these processes is executed, for example, at predetermined time intervals. In Step ST31, the controller 50 determines whether the sensor 52 has detected the height and the position of the vehicle 6. In the presence of a plurality of the vehicles 6 in the detection target range, the sensor 52 detects the height and the position in association with each other, for each of the vehicles 6. In the absence of the vehicle 6 in the detection target range, the sensor 52 does not detect the height and the position.

When determining that the sensor 52 does not detect the height and the position of the vehicle 6, the controller 50 ends the processes. When determining that the sensor 52 has detected the height and the position, the controller 50 determines whether the identification information (i.e., the address information) and the position information have been received from the vehicle 6 in Step ST32. In the absence of the vehicle 6 within communicating distance of the roadside unit 5 or when the vehicle 6 does not have a function of communicating with the roadside unit 5, the controller 50 cannot receive these pieces of information. When determining no reception of the identification information and the position information, the controller 50 ends the processes. When determining the reception of the identification information and the position information, the controller 50 associates the vehicle height information and the identification information (i.e., the address information) of the same vehicle 6 with each other, based on the position information from the sensor 52 and the position information from the vehicle 6 in Step ST33.

Next in Step ST34, the controller 50 determines, for each of the vehicles 6, whether the vehicle height detected by the sensor 52 is larger than a reference value to determine the presence or absence of the vehicle 6 whose height is larger than the reference value. When determining that the heights of all the vehicles 6 are smaller than the reference value, the controller 50 ends the processes. When determining the presence of the vehicle 6 whose height is larger than the reference value, the controller 50 transmits the warning information through the wireless communication unit 51 using, as the address information, the identification information corresponding to the vehicle height information indicating the vehicle height larger than the reference value in Step ST35. For example, when determining that the height of the vehicle 6*b* is larger than the reference value, the controller 50 incorporates, into a signal, the warning information and the address information Db corresponding to the vehicle height information Hb, and transmits the signal.

Upon receipt of the signal, the vehicle 6*b* determines that the signal is a signal addressed to the vehicle 6*b*, based on the address information Db. The controller 60 of the vehicle 6*b* retrieves the warning information from the signal, and controls the notifier 63 so that, for example, the notifier 63 should notify the driver of this warning information. Upon receipt of the signal, the other vehicles 6*a* and 6*c* to 6*f* determine that the signal does not contain the address information of its own vehicle. Thus, for example, the other vehicles 6*a* and 6*c* to 6*f* do not make any notification.

Since the controller 50 of the roadside unit 5 can transmit the warning information only to the vehicle 6 whose height is larger than the reference value, the vehicle 6 (the controller 60) can appropriately recognize that its height exceeds the reference value. Thus, the controller 60 of the vehicle 6 can notify the driver of this, or appropriately restrain the vehicle 6 from entering the restriction section by controlling the driving mechanism 64.

In the aforementioned example, the controller 50 of the roadside unit 5 sets the address information to each of the vehicles 6, and associates the address information and the vehicle height information of the same vehicle 6 with each other, based on the position information from the vehicle 6 and the position information from the sensor 52. However, associating the address information with the vehicle height information does not always require the position information.

In other words, information that can distinguish the vehicle 6 (will be referred to as distinguishing information) and that can be independently obtained by each of the vehicle 6 and the sensor 52 may be used. Except for the position information, information on, for example, the vehicle model (including the color and the shape) and the vehicle registration plate of the vehicle 6 can be adopted as the distinguishing information. Since the identification information is information classified as the distinguishing information in that the identification information can distinguish the vehicle 6, differences between this identification information and the distinguishing information will be described. The distinguishing information is information for associating the identification information (the address information) from the vehicle 6 and the vehicle height information from the sensor 52 with each other. Thus, each of the vehicle 6 and the sensor 52 needs to obtain the information independently.

For example, the vehicle model and the vehicle registration plate are prestored in the storage 603 of the vehicle 6. The controller 60 of the vehicle 6 can obtain the information by accessing the storage 603.

The sensor 52 can retrieve a feature volume on the shape, etc., of the vehicle 6 through, for example, the image analysis on a three-dimensional image, and identify the vehicle model based on this feature volume. The sensor 52 may comprise a camera. The sensor 52 may perform the image analysis on an image captured by the camera to identify the vehicle 6, and also identify the color of the vehicle 6 based on the colors of pixels representing the vehicle 6.

The sensor 52 may detect the vehicle registration plate shown in the front portion of the vehicle 6, through the image analysis on the captured image. Although any image analysis may be used as such image analysis, one of the examples will be simply described. For example, the sensor 52 retrieves, from a captured image, a character region with characters of the vehicle registration plate, and identifies the characters in the character region by comparing (or checking) character shapes in the character region with preregistered character shapes. The sensor 52 detects the vehicle registration plate by identifying the characters one by one.

The controller 60 of the vehicle 6 can obtain the identification information since the identification information is stored in the storage 603 of the vehicle 6. However, the sensor 52 need not detect the identification information because the identification information is used for setting the address information. The sensor 52 does not detect, for example, the serial number of the vehicle 6 that is one example of the identification information. In this respect, the identification information is different from the distinguishing information.

Next, associating the address information with the vehicle information using the distinguishing information will be described. The sensor 52 associates the vehicle model information with the distinguishing information (will be hereinafter referred to as the first distinguishing information) for each of the vehicles 6, and outputs them to the controller 50. For example, the sensor 52 associates the first distinguishing information Qa1 and the vehicle height information Ha of the vehicle 6*a* with each other. The same holds true for the vehicles 6*b* to 6*f*.

The controller 50 receives the identification information and the distinguishing information (will be hereinafter referred to as the second distinguishing information) from the vehicle 6, and associates this second distinguishing information with the address information (e.g., the identification information). For example, the controller 50 associates the second distinguishing information Qa2 and the address information Da of the vehicle 6 with each other. Then, the controller 50 associates the address information and the vehicle height information on the same vehicle 6 with each other, based on the first distinguishing information from the sensor 52 and the second distinguishing information from the vehicle 6. Specifically, the controller 50 identifies the first distinguishing information Qa1 corresponding to the second distinguishing information Qa2, and associates the vehicle height information Ha corresponding to the first distinguishing information Qa1 with the address information Da corresponding to the second distinguishing information Qa2. The same holds true for the vehicles 6*b* to 6*f*.

As described above, the address information can be associated with the vehicle height information for each of the vehicles 6.

In the aforementioned example, the roadside unit 5 transmits the warning information to a particular one of the vehicles 6 using the address information. However, the roadside unit 5 may transmit the warning information to the particular vehicle 6 using an encryption key, which will be specifically described below.

The controller 50 of the roadside unit 5 may perform an encryption process on the warning information using the encryption key. The controller 50 can transmit the encrypted warning information to the surrounding objects through the wireless communication unit 51.

The controller 60 of the vehicle 6 can receive the encrypted warning information through the wireless communication unit 61. The controller 60 can perform a decoding process on this warning information using the encryption key.

Figure 9:
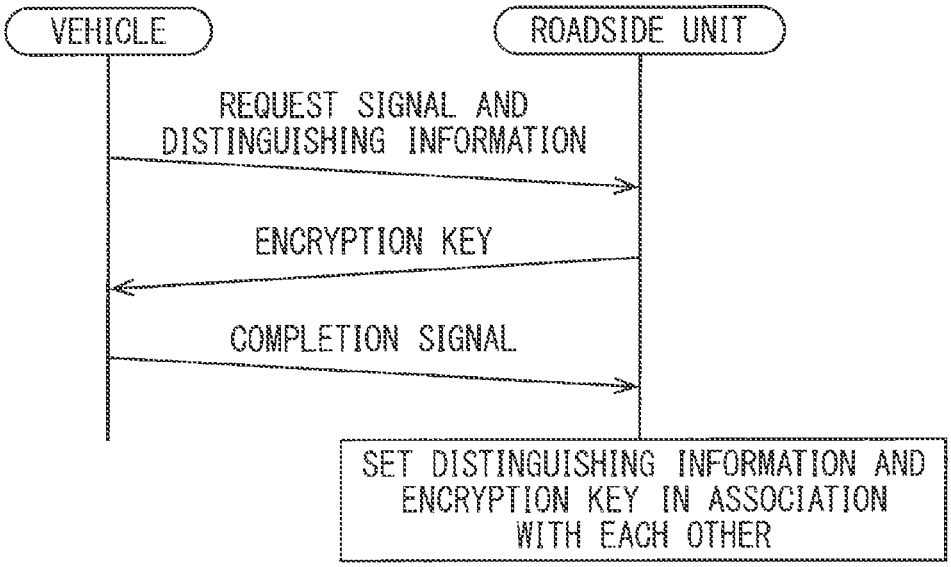
FIG. 9 illustrates one example of operations between the vehicle and the roadside unit.

The roadside unit 5 and the vehicle 6 may set an encryption key to be used between them when the roadside unit 5 and the vehicle 6 start communication. FIG. 9 schematically illustrates one example communication between the roadside unit 5 and the vehicle 6. When the vehicle 6 reaches a position at which communication with the roadside unit 5 is possible, the controller 60 of the vehicle 6 transmits the second distinguishing information and a request signal requesting an encryption key, for example, in multicast. Upon receipt of these, the controller 50 of the roadside unit 5 generates the encryption key for the vehicle 6, and transmits this encryption key, for example, in multicast. Upon receipt of this, the vehicle 6 to which the encryption key has not been set yet sets this encryption key, and transmits, for example in multicast, a completion signal indicating completion of the setting. Upon receipt of the completion signal, the roadside unit 5 sets the encryption key and the second distinguishing information in association with each other. This association between the encryption key and the second distinguishing information is used to associate the encryption key and the vehicle information from the sensor 52 with each other.

When an encryption key is set between each of the plurality of vehicles 6 and the roadside unit 5, the encryption key may be set for each of the vehicles 6 one by one. For example, upon receipt of the request signals from the other vehicles 6, each of the vehicles 6 waits to transmit a request signal until reception of the completion signals from the other vehicles 6, and does not perform an operation of setting the encryption key. In other words, the vehicle 6 may transmit the request signal after the encryption keys are set between the roadside unit 5 and the other vehicles 6. Consequently, the roadside unit 5 can set different encryption keys Ka to Kf with the vehicles 6*a* to 6*f*, respectively, one by one.

The controller 50 of the roadside unit 5 performs an encryption process on the warning information for the vehicle 6 using the encryption key to transmit the warning information. For example, the controller 50 performs an encryption process on the warning information for the vehicle 6*b* based on the encryption key Kb to transmit the encrypted warning information. Each of the controllers 60 of the vehicles 6*a* to 6*f* receives the encrypted warning information, and performs a decoding process on the encrypted warning information using the encryption key set to its own vehicle. Thus, only the controller 60 of the vehicle 6*b* can accurately decode the warning information using the encryption key Kb. Consequently, the roadside unit 5 can transmit the warning information to a particular one of the vehicles 6. Since the warning information is encrypted, the confidentiality of the warning information can be improved.

The encryption keys set to the vehicles 6*a* to 6*f* may be associated with the pieces of vehicle height information obtained for the vehicles 6*a* to 6*f*, respectively, based on the pieces of distinguishing information similarly as above. Specifically, the sensor 52 outputs the vehicle height information in association with the first distinguishing information for each of the vehicles 6. The controller 50 associates the encryption key and the vehicle height information with each other, based on the first distinguishing information and the second distinguishing information.

Figure 10:
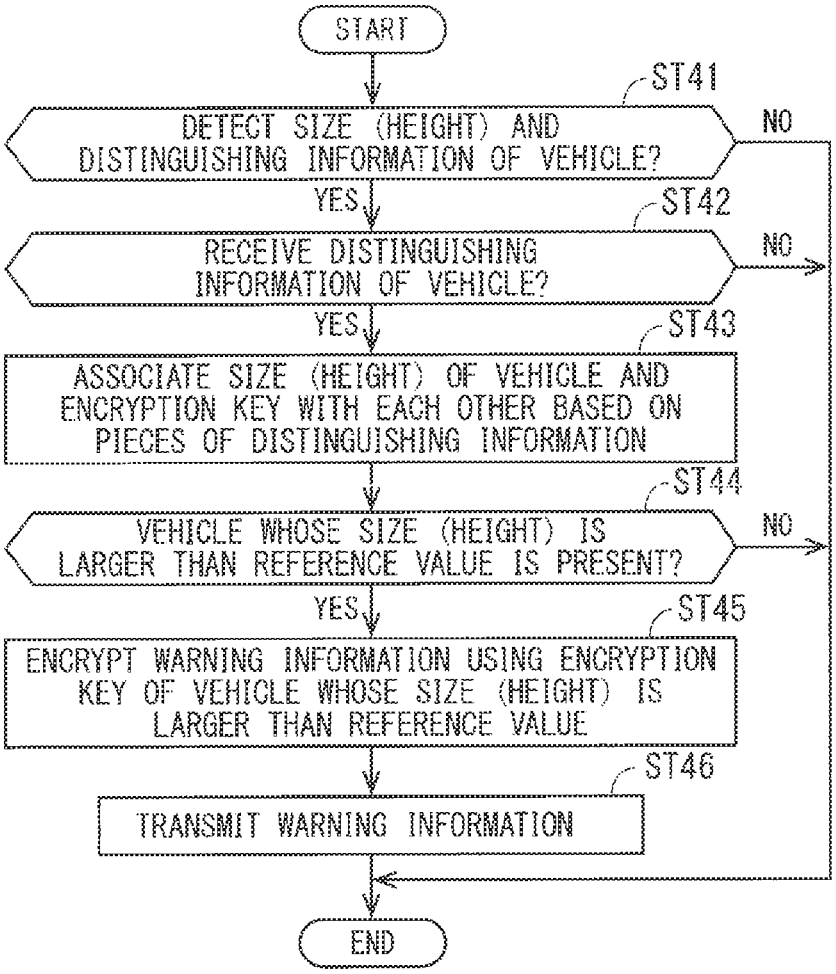
FIG. 10 illustrates a flowchart showing one example of the operations of the roadside unit.

FIG. 10 illustrates a flowchart showing one specific example of the operations of the roadside unit 5. A series of these processes is executed, for example, at predetermined time intervals. Here, adoption of the vehicle registration plate as the distinguishing information will be hereinafter described. In Step ST41, the controller 50 determines whether the sensor 52 has detected the height and the first distinguishing information (e.g., the vehicle registration plate) of the vehicle 6. When determining that the sensor 52 does not detect the height and the first distinguishing information of the vehicle 6, the controller 50 ends the processes. When determining that the sensor 52 has detected the height and the first distinguishing information, the controller 50 determines whether the second distinguishing information (e.g., the vehicle registration plate) has been received from the vehicle 6 in Step ST42. When determining no reception of the second distinguishing information, the controller 50 ends the processes.

When determining the reception of the second distinguishing information, the controller 50 associates the vehicle height information and the encryption key of the same vehicle 6 with each other, based on the first distinguishing information from the sensor 52 and the second distinguishing information from the vehicle 6 in Step ST43. Specifically, the controller 50 associates, with each other, the vehicle height information and the encryption key which correspond to the first distinguishing information and the second distinguishing information that coincide with each other.

Next in Step ST44, the controller 50 determines, for each of the vehicles 6, whether the vehicle height is larger than a reference value to determine the presence or absence of the vehicle 6 whose height is larger than the reference value. When determining that the heights of all the vehicles 6 are smaller than the reference value, the controller 50 ends the processes. When determining the presence of the vehicle 6 whose height is larger than the reference value, the controller 50 performs an encryption process on the warning information using the encryption key corresponding to the vehicle height information indicating the height larger than the reference value in Step ST45.

For example, when determining that the heights of the vehicles 6*a* and 6*b* are larger than the reference value, the controller 50 performs an encryption process on the warning information using the encryption key Ka corresponding to the vehicle height information Ha, and performs an encryption process on the warning information using the encryption key Kb corresponding to the vehicle height information Hb. Next in Step ST46, the controller 50 transmits the encrypted warning information through the wireless communication unit 51. For example, the controller 50 transmits the warning information encrypted by the encryption key Ka and the warning information encrypted by the encryption key Kb. These pieces of warning information are accurately decoded by the controllers 60 of the vehicles 6*a* and 6*b* whose height is larger than the reference value, and are not accurately decoded by the vehicles 6*c* to 6*f*.

Since the vehicles 6 can obtain the distinguishing information, the roadside unit 5 may incorporate the distinguishing information detected by the sensor 52 into a signal, and transmit the signal. In other words, this distinguishing information may be used as the address information.

Figure 11:
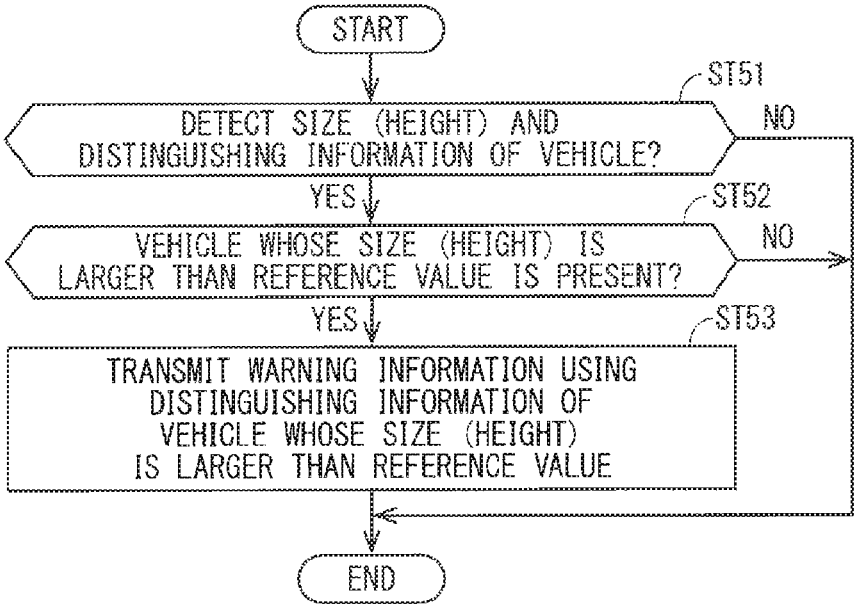
FIG. 11 illustrates a flowchart showing one example of the operations of the roadside unit.

FIG. 11 illustrates a flowchart showing one example of the operations of the roadside unit 5. A series of these processes is executed, for example, at predetermined time intervals. In Step ST51, the controller 50 determines whether the sensor 52 has detected the vehicle height information and the first distinguishing information (the vehicle registration plate). When determining that the sensor 52 does not detect these, the controller 50 ends the processes. When determining detection of these, the controller 50 determines the presence or absence of the vehicle 6 whose height is larger than the reference value in Step ST52. When determining the absence of such vehicle 6, the controller 50 ends the processes. When determining the presence of such vehicle 6, the controller 50 transmits the warning information using the first distinguishing information corresponding to the vehicle height information indicating the vehicle height larger than the reference value in Step ST53. For example, the controller 50 transmits the warning information using the first distinguishing information as the address information. Specifically, the controller 50 incorporates the first distinguishing information and the warning information into a signal and transmits the signal. For example, when determining that the height of the vehicle 6*b* is larger than the reference value, the controller 50 incorporates the first distinguishing information of the vehicle 6*b* and the warning information into a signal and transmits the signal.

Upon receipt of the signal, the controller 60 of the vehicle 6 retrieves the first distinguishing information from the signal, and determines whether that the first distinguishing information coincides with the second distinguishing information of its own vehicle. When determining that the received first distinguishing information coincides with the second distinguishing information, the controller 60 determines that the warning information contained in the signal is the information addressed to its own vehicle. When determining that the received first distinguishing information is different from the second distinguishing information, the controller 60 determines that the warning information is not the information addressed to its own vehicle.

Also in this way, the roadside unit 5 can transmit the warning information only to the vehicle 6 whose height is larger than the reference value. Moreover, since the setting of the address information does not require the identification information from the vehicle 6, the communication volume of the traffic communication system 1 can be reduced. Reduction in the communication volume enables the other devices to easily communicate and transmit a signal with a high priority. When the roadside unit 5 communicates with the vehicle 6 at a low communication speed (e.g., with a few number of channels), the reduction in the communication volume is particularly important.

In Step ST53 of FIG. 11, the controller 50 of the roadside unit 5 may perform an encryption process on the warning information using the first distinguishing information as the encryption key, and transmit the encrypted warning information through the wireless communication unit 51.

The controller 60 of the vehicle 6 performs a decoding process on the received warning information using the second distinguishing information of its own vehicle as the encryption key. For example, when the roadside unit 5 performs an encryption process using the first distinguishing information of the vehicle 6*b* as the encryption key, only the vehicle 6*b* can accurately decode this warning information. Also in this way, the roadside unit 5 can transmit the warning information only to the vehicle 6 whose height is larger than the reference value. Moreover, since the warning information is encrypted, the confidentiality of the warning information can be improved.

When the wireless communication units 51 and 61 can transmit and receive signals over a plurality of communication channels (e.g., a plurality of communication frequency bands), the roadside unit 5 may set a communication channel to be used for communication, to each of the vehicles 6.

Figure 12:
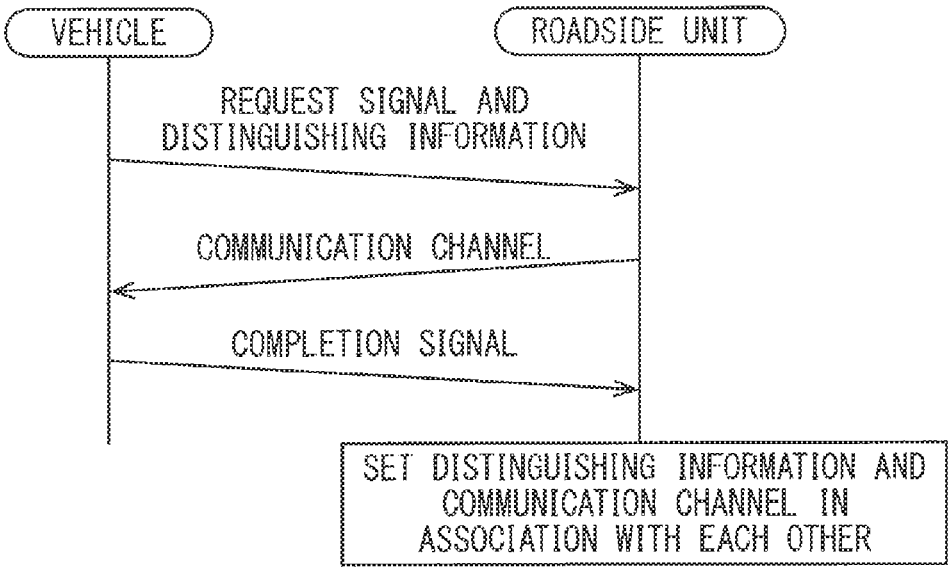
FIG. 12 illustrates one example of the operations between the vehicle and the roadside unit.

A method for setting a communication channel is similar to, for example, the method for setting the encryption key that is described with reference to FIG. 9. FIG. 12 illustrates one example method for setting a communication channel. For example, the controller 60 of the vehicle 6 transmits the second distinguishing information and a request signal requesting the setting of a communication channel, for example, in multicast. Upon receipt of this request signal, the controller 50 of the roadside unit 5 selects one of unused communication channels, and transmits information indicating the selected communication channel, for example, in multicast. Upon receipt of this information, the controller 60 of the vehicle 6 to which the communication channel has not been set yet sets this communication channel, and transmits the completion signal, for example, in multicast. In response to the receipt of the completion signal, the controller 50 of the roadside unit 5 sets the communication channel and the second distinguishing information in association with each other. Consequently, the selected communication channel is allocated to the communication between the roadside unit 5 and the vehicle 6. Subsequently, the roadside unit 5 and the vehicle 6 communicate over the set communication channel.

The controller 50 associates the communication channel and the vehicle information of the same vehicle 6 with each other, based on the first distinguishing information and the second distinguishing information as described above.

Since the roadside unit 5 communicates over a different communication channel for each of the vehicles 6, it can transmit the warning information only to a particular one of the vehicles 6. Since the address information need not be incorporated into a signal, the communication volume of the traffic communication system 1 can be reduced.

In the aforementioned example, the sensor 52 detects the height of the vehicle 6, and outputs, to the controller 50, the vehicle height information indicating the detected value. However, the operation is not necessarily limited thereto. For example, the vehicle height information may be prestored in the storage 603 of the vehicle 6. This vehicle height information indicates, for example, the height of the vehicle 6 that does not contain goods. The controller 60 of the vehicle 6 transmits, to the roadside unit 5 through the wireless communication unit 61, the vehicle height information stored in the storage 603. The controller 60 transmits the identification information of the vehicle 6 together with this vehicle height information.

Upon receipt of the vehicle height information from the vehicle 6 through the wireless communication unit 61, the controller 50 of the roadside unit 5 determines, based on the vehicle height information, whether the height of the vehicle 6 is larger than the reference value. When determining that the vehicle height is larger than the reference value, the controller 50 transmits the warning information using the identification information as the address information.

In this way, the warning information can be transmitted to the vehicle 6 whose height is larger than the reference value. Moreover, the sensor 52 is unnecessary.

The controller 50 may make the determination on the vehicle height, using both the first vehicle height information received from the vehicle 6 and the second vehicle height information output from the sensor 52. The first vehicle height information from the vehicle 6 indicates, for example, the height of the vehicle 6 that does not contain goods. When the vehicle 6 loads goods on, for example, a carrier, the second vehicle height information from the sensor 52 indicates the height of the vehicle 6 that contains the goods. In other words, the vehicle height indicated by the second vehicle height information may be higher than that indicated by the first vehicle height information. Meanwhile, the process of detecting the vehicle height using the sensor 52 is complicated because it involves, for example, image analysis.

Thus, the controller 50 determines, first based on the first vehicle height information, whether the vehicle height is larger than the reference value. When determining that the vehicle height is larger than the reference value, the controller 50 transmits the warning information. Here, the sensor 52 need not detect the vehicle height.

When determining that the vehicle height is smaller than the reference value, the sensor 52 detects the height of the vehicle 6, and outputs, to the controller 50, the detected value as the second vehicle height information. The controller 50 determines whether the vehicle height is larger than the reference value, based on the second vehicle height information. When determining that the vehicle height is larger than the reference value, the controller 50 transmits the warning information.

As described above, the controller 50 first makes the determination on the vehicle height, based on the first vehicle height information that can be easily obtained, and transmits the warning information when the vehicle height is larger than the reference value. Here, the sensor 52 need not detect the height of the vehicle 6. In other words, when the vehicle height indicated by the first vehicle height information is larger than the reference value, it is conceivable that the same determination result will be produced from the second vehicle height information indicating the vehicle height larger than that indicated by the first vehicle height information. Thus, the sensor 52 does not detect the vehicle height. Consequently, the processing of the roadside unit 5 can be simplified.

Even through the determination result on the vehicle height using the first vehicle height information indicating the height of the vehicle 6 that does not contain goods is negative, the controller 50 may yield an affirmative determination result on the vehicle height based on the second vehicle height information. Here, the controller 50 makes the determination on the vehicle height, based on the second vehicle height information. Thus, the warning information can be notified more accurately.

Figure 13:
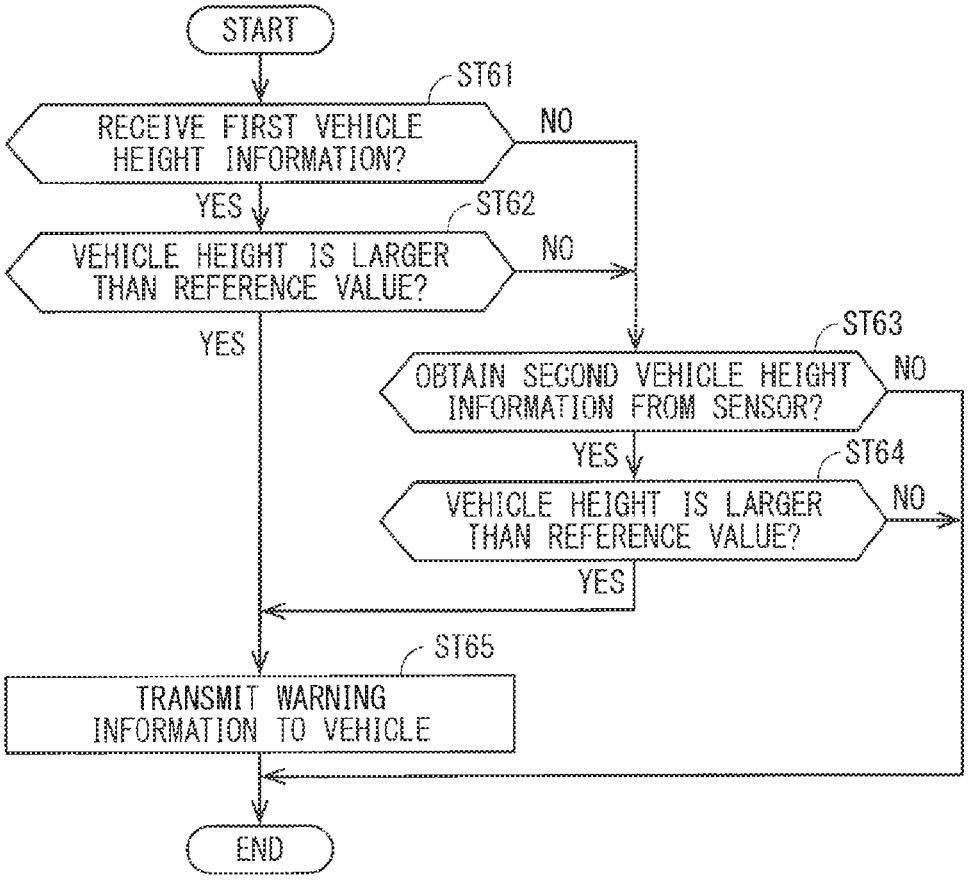
FIG. 13 illustrates a flowchart showing one example of the operations of the roadside unit.

FIG. 13 illustrates a flowchart showing one example of the operations of the roadside unit 5. First in Step ST61, the controller 50 determines whether the first vehicle height information has been received from the vehicle 6. When determining the reception of the first vehicle height information, the controller 50 determines whether the vehicle height is larger than the reference value, based on the first vehicle height information in Step ST62. When determining that the vehicle height is larger than the reference value, the controller 50 transmits the warning information to the vehicle 6 in Step ST65, and ends the processes. Here, the sensor 52 neither detects the vehicle height nor makes a determination on the vehicle height based on the detected value (the second vehicle height information).

When making a negative determination in Step ST61 or ST62, the controller 50 determines whether the second vehicle height information has been obtained from the sensor 52 in Step ST63. When determining that the controller 50 has obtained the second vehicle height information, the controller 50 determines whether the vehicle height is larger than the reference value, based on the second vehicle height information in Step ST64. When determining that the vehicle height is larger than the reference value, the controller 50 transmits the warning information in Step ST65, and ends the processes. When making a negative determination in Step ST63 or ST64, the controller 50 ends the processes.

In the aforementioned example, the controller 50 of the roadside unit 5 transmits the warning information to the vehicle 6 whose height is larger than the reference value. However, even when the vehicle height is larger than the reference value, the necessity to transmit the warning information to the vehicle 6 that does not proceed to the road 7*d* is low. Thus, the controller 50 may determine whether transmission of the warning information is necessary, based on not only the vehicle height but also the traveling direction of the vehicle 6, which will be specifically described below.

The roadside unit 5 may obtain predicted path information indicating a traveling direction of the vehicle 6. For example in FIG. 1, the lanes 72 to 75 are lanes with restrictions on traveling direction. Thus, the traveling direction of the vehicle 6 can be identified according to a lane in which the vehicle 6 is located. Thus, the controller 50 may obtain, as the predicted path information, the position information of the vehicle 6 and lane information indicating a range of the lanes 72 to 75. Specifically, the controller 50 may obtain the position information of the vehicle 6 from, for example, the sensor 52. The lane information may be preset and stored in, for example, the storage 503. The lane range is indicated by a range using, for example, the latitude and longitude. The controller 50 identifies which one of the lanes 72 to 75 covers the position of the vehicle 6 detected by the sensor 52.

The controller 50 determines whether the traveling direction of the vehicle 6 is a direction toward the road 7*d*, according to a lane in which the vehicle 6 is located. Specifically, the controller 50 determines that the traveling direction of the vehicle 6 is not the direction toward the road 7*d* when the vehicle 6 is located in one of the lanes 72 to 74, and determines that the traveling direction of the vehicle 6 is the direction toward the road 7*d* when the vehicle 6 is located in the lane 75.

Figure 14:
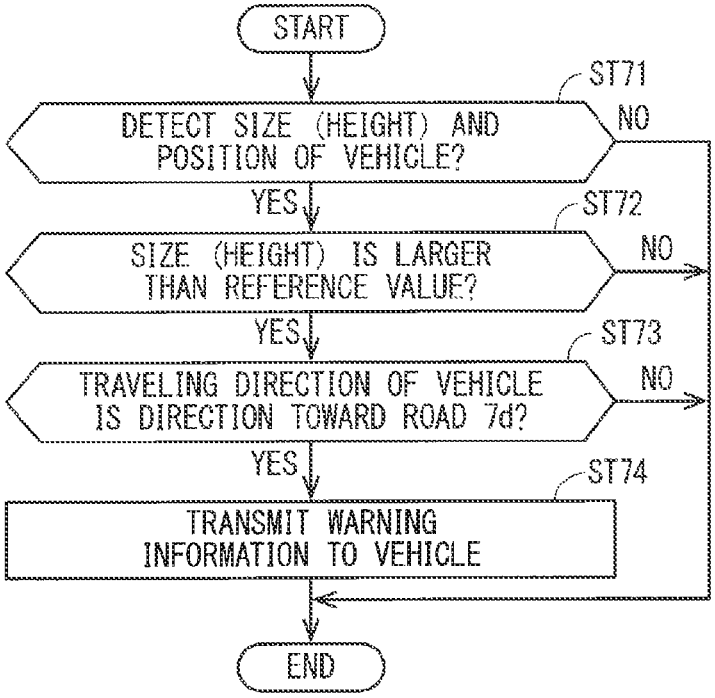
FIG. 14 illustrates a flowchart showing one example of the operations of the roadside unit.

FIG. 14 illustrates a flowchart showing one example of the operations of the controller 50 of the roadside unit 5. A series of these processes is executed, for example, at predetermined time intervals. In Step ST71, the controller 50 determines whether the sensor 52 has detected the height and the position of the vehicle 6. When determining that the sensor 52 does not detect the height and the position, the controller 50 ends the processes. When the sensor 52 has detected the height and the position, the controller 50 determines whether the vehicle height is larger than the reference value in Step ST72. When determining that the vehicle height is smaller than the reference value, the controller 50 ends the processes. When determining that the vehicle height is larger than the reference value, the controller 50 determines whether the traveling direction of the vehicle 6 is the direction toward the road 7*d* in Step ST73. Specifically, when determining that the lane 75 covers the position of the vehicle 6, based on the position information and the lane information, the controller 50 determines that the traveling direction is the direction toward the road 7*d*. When determining that the traveling direction is not the direction toward the road 7*d*, the controller 50 ends the processes. When determining that the traveling direction is the direction toward the road 7*d*, the controller 50 transmits the warning information to the vehicle 6 traveling toward the road 7*d* in Step ST74.

Consequently, when it is predicted that the vehicle 6 whose height is larger than the reference value will pass through the road 7*d*, the warning information is transmitted to the vehicle 6. Thus, the warning information can be transmitted more appropriately. Conversely speaking, when it is predicted that the vehicle 6 will not pass through the road 7*d* even in the case where the vehicle height is larger than the reference value, the warning information is not transmitted to the vehicle 6. Thus, transmission of the warning information with low necessity can be reduced. Thus, the communication volume of the traffic communication system 1 can be reduced.

In the aforementioned example, the position information indicating the position of the vehicle 6 and the lane information indicating the lane range are adopted as the predicted path information. Here, the roadside unit 5 obtains the position information of the vehicle 6 from the sensor 52, and obtains the lane information from the storage 503. In other words, the roadside unit 5 need not receive the predicted path information from the vehicle 6. This can also reduce the communication volume of the traffic communication system 1.

The sensor 52 associates the vehicle height information with the position information (the predicted path information) for each of the vehicles 6, and outputs them to the controller 50. The controller 50 makes the determinations on the vehicle height (Step ST72) and on the traveling direction (Step ST73) for each of the vehicles 6. Thus, the controller 50 can identify the vehicle 6 whose height is larger than the reference value and whose traveling direction is the direction toward the road 7*d*. The transmission method to a particular one of the vehicles 6 is the same as the aforementioned method. In other words, the controller 50 may associate the address information, a communication channel or an encryption key, the vehicle height information, and the predicted path information with one another, based on the distinguishing information for each of the vehicles 6. Since the details herein are the same in the following aspects to be described below, the repeated description will be avoided.

In the aforementioned example, the position information indicating the position of the vehicle 6 and the lane information indicating the range of the lanes 72 to 75 are adopted as the predicted path information. However, the predicted path information is not limited thereto. For example, indicator information indicating a state of the direction indicators 65 of the vehicle 6 may be adopted. This is because the direction indicators 65 indicate a traveling direction of the vehicle 6. For example, when the direction indicators 65 in the right end portions of the vehicle 6 exhibit an emission color (e.g., yellow), the vehicle 6 turns right at the intersection 2. When the direction indicators 65 in the left end portions of the vehicle 6 exhibit the emission color, the vehicle 6 turns left at the intersection 2 When none of the direction indicators 65 exhibits the emission color, the vehicle 6 goes straight through the intersection 2.

The controller 50 obtains this indicator information. For example, the sensor 52 comprises a camera. With reference to FIG. 1, the camera is installed so that it can capture, for example, an image of the front portions of the vehicles 6 passing through the lanes 72 to 75 of the road 7*a*, from above the vicinity of the intersection 2.

The sensor 52 can detect a state of the direction indicators 65 mounted on the front portion of the vehicle 6 through image analysis on the image captured by this camera. For example, the sensor 52 identifies the direction indicators 65 mounted on the front portion of the vehicle 6 from the captured image, and detects the colors of pixels representing the direction indicators 65 as a state of the direction indicators 65. Such identification retrieves a feature volume (e.g., HOG features) from the captured image, and distinguishes between the vehicle 6 (further, the direction indicators 65 in the front portion) and the others based on this feature volume. Machine learning, for example, Support Vector Machine (SVM) may be used for this identification.

The controller 50 may determine whether the traveling direction is the direction toward the road 7*d*, according to a state of the direction indicators 65 mounted on the front portion of the vehicle 6. In the example of FIG. 1, the vehicles 6 passing through the road 7*a* (the lane 75) turn left to travel to the road 7*d*. Here, when the direction indicator 65 in the left end portion in the front portion of the vehicle 6 exhibits the emission color, the controller 50 may determine that the traveling direction of the vehicle 6 is the direction toward the road 7*d*.

Figure 15:
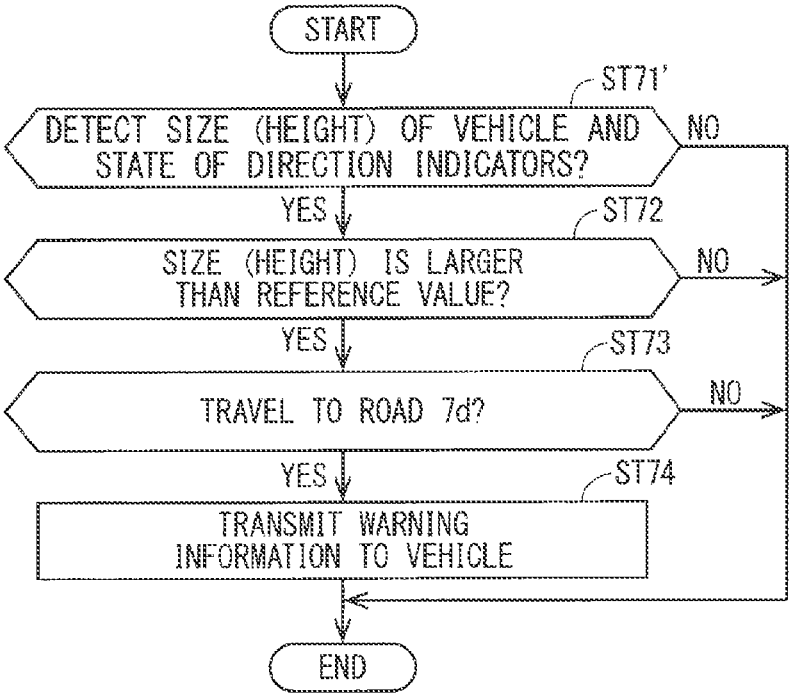
FIG. 15 illustrates a flowchart showing one example of the operations of the roadside unit.

FIG. 15 illustrates a flowchart showing one example of the operations of the roadside unit 5. In FIG. 15, the process of Step ST71' is executed as a replacement for the process of Step ST71 in FIG. 14. In Step ST71', the controller 50 determines whether the sensor 52 has detected the height of the vehicle 6 and the state of the direction indicators 65. In Step ST73, the controller 50 determines whether the traveling direction of the vehicle 6 is the direction toward the road 7*d*, based on the detected state of the direction indicators 65. In other words, the controller 50 determines whether the indicator information indicates travel to the road 7*d*. Specifically, the controller 50 determines whether the direction indicator 65 in the left end portion in the front portion of the vehicle 6 emits light, based on the indicator information. The controller 50 determines that the traveling direction of the vehicle 6 is the direction toward the road 7*d*, when determining that the direction indicator 65 exhibits the emission color.

As described above, since the controller 50 determines the traveling direction based on the state of the direction indicators 65, it can make such a determination even when the road 7*a* does not consist of a plurality of lanes. Since the sensor 52 detects a state of the direction indicators 65 in the aforementioned example, the controller 50 need not receive the indicator information from the vehicle 6. Thus, the communication volume of the traffic communication system 1 can be reduced.

In the aforementioned example, the controller 50 of the roadside unit 5 obtains the predicted path information from the sensor 52. However, the controller 50 may receive the predicted path information from the vehicle 6. For example, when the vehicle 6 comprises the navigation device 67, the route information generated by the navigation device 67 may be adopted as the predicted path information. The controller 60 of the vehicle 6 transmits this route information to the roadside unit 5 through the wireless communication unit 61. The controller 50 of the roadside unit 5 receives this route information through the wireless communication unit 51. The controller 50 may determine whether the traveling direction is the direction toward the road 7*d*, based on whether the route information contains the road 7*d*. When the route information contains the road 7*d*, the controller 50 may determine that the traveling direction is the direction toward the road 7*d*.

Figure 16:
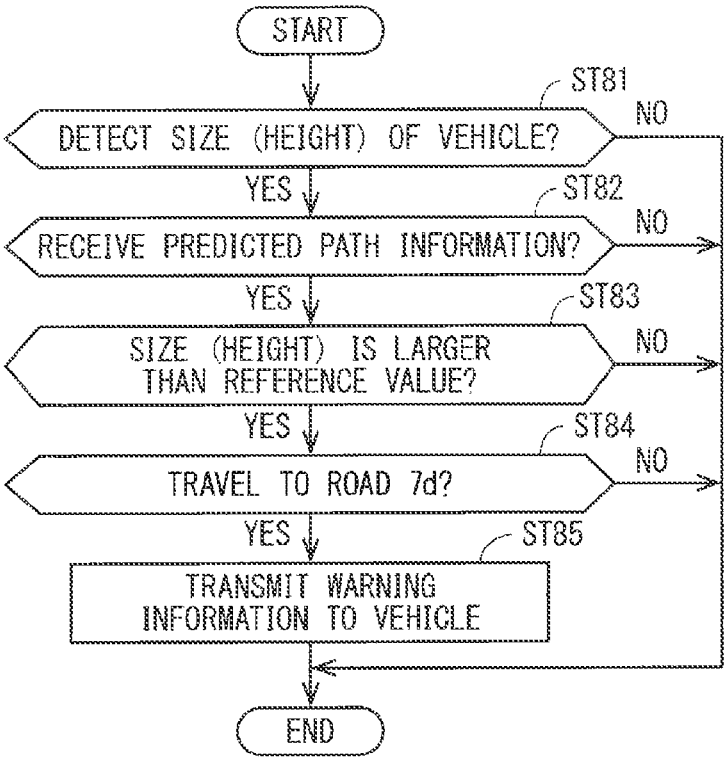
FIG. 16 illustrates a flowchart showing one example of the operations of the roadside unit.

FIG. 16 illustrates a flowchart showing one example of the operations of the roadside unit 5. A series of these processes is executed, for example, at predetermined time intervals. In Step ST81, the controller 50 determines whether the sensor 52 has detected the height of the vehicle 6. When determining that the sensor 52 has detected the height, the controller 50 determines whether the predicted path information (here, the route information) has been received from the vehicle 6 in Step ST82. When determining the receipt of the predicted path information, the controller 50 determines whether the height of the vehicle 6 is larger than the reference value in Step ST83. When determining that the vehicle height is larger than the reference value, the controller 50 transmits the warning information to the vehicle 6 in Step ST84. When making a negative determination in each of Steps ST81 to ST84, the controller 50 ends the processes.

This eliminates the need for the sensor 52 to detect the predicted path information. Since the process performed by the sensor 52 involves, for example, image analysis and thus is complicated, the processing on the roadside unit 5 side can be simplified. Moreover in the aforementioned example, the route information generated by the navigation device 67 is adopted as the predicted path information. The navigation device 67 generates this route information to guide the driver to a destination. Thus, the controller 60 of the vehicle 6 need not newly generate the predicted path information. Thus, the processing on the vehicle 6 side can be simplified more than that when the predicted path information different from the route information is generated.

The controller 60 of the vehicle 6 may transmit the indicator information indicating the state of the direction indicators 65 to the roadside unit 5 through the wireless communication unit 61 as the predicted path information. The controller 60 of the vehicle 6 can obtain the indicator information indicating the state of the direction indicators 65. For example, the sensor 68 may detect a state of the direction indicators 65, and output, to the controller 60, the detection result as the indicator information. Alternatively, the operators 66 may output, to the controller 60, an operation signal indicating an operation performed on the direction indicators 65 as the indicator information.

The controller 50 of the roadside unit 5 may make a determination on the traveling direction, based on the indicator information as described above. This also enables the controller 50 to make the determination on the traveling direction. Since the information volume of the indicator information is smaller than that of the route information, the communication volume of the traffic communication system 1 can be reduced.

The controller 60 of the vehicle 6 may transmit wheel information indicating the orientation of the wheels to the roadside unit 5 through the wireless communication unit 61 as the predicted path information. The controller 60 of the vehicle 6 can obtain the wheel information indicating the orientation of the wheels. For example, the sensor 68 may detect an amount of operations of the operator (i.e., a steering wheel) for operating the orientation of the wheels, and output the detected value to the controller 60 as the wheel information.

The controller 50 of the roadside unit 5 may make a determination on the traveling direction, based on the wheel information. For example, the controller 50 determines that the vehicle 6 turns left when the orientation of the wheels are significantly tilted left about a predetermined angle relative to the front direction of the vehicle 6 to determine that the traveling direction is the direction toward the road 7*d*. As described above, the controller 50 can make a determination on the traveling direction. Since the information volume of the wheel information is smaller than that of the route information, the communication volume of the traffic communication system 1 can be reduced.

A plurality of different types of the predicted path information may be adopted. For example, the route information is adopted as the first predicted path information, whereas the indicator information is adopted as the second predicted path information.

Figure 17:
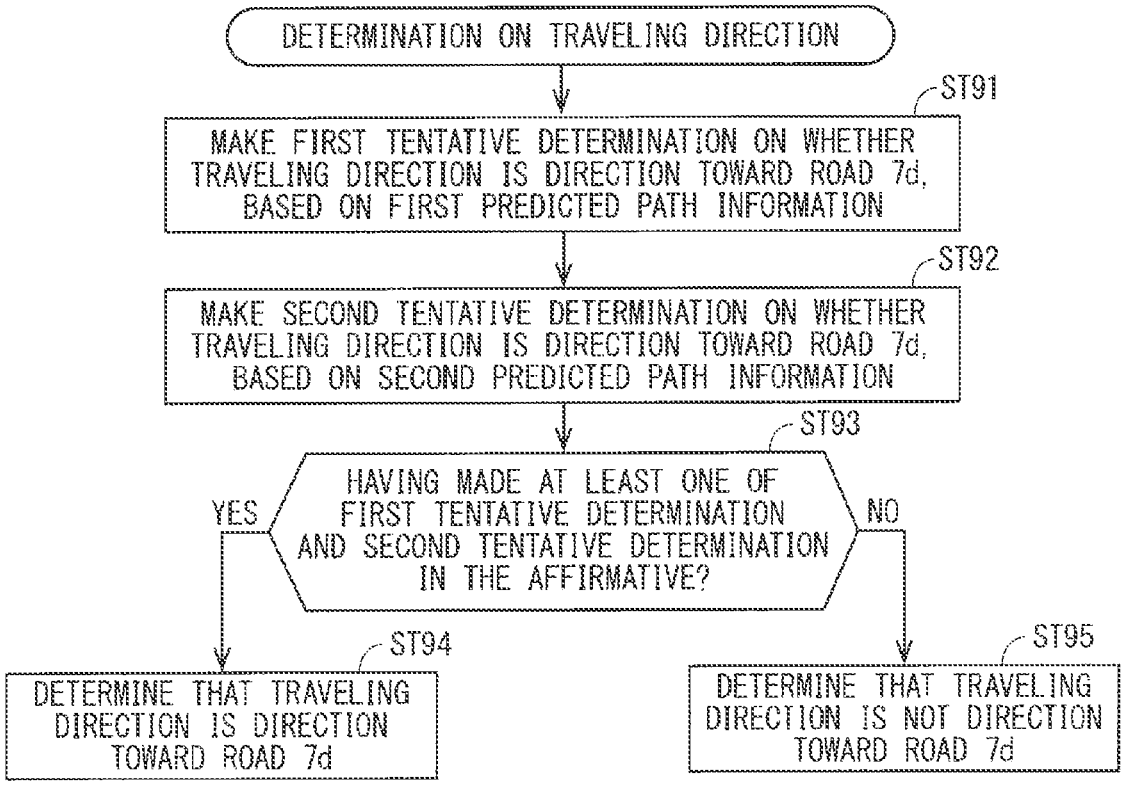
FIG. 17 illustrates a flowchart showing one example of the operations of the roadside unit.

FIG. 17 illustrates a flowchart showing one example determination on the traveling direction to be made by the controller 50. In Step ST91, the controller 50 makes the first tentative determination on whether the traveling direction of the vehicle 6 is the direction toward the road 7*d*, based on the first predicted path information. For example, the controller 50 makes the first tentative determination in the affirmative when determining that the lane 75 covers the position of the vehicle 6 as described above.

Next in Step ST92, the controller 50 makes the second tentative determination on whether the traveling direction of the vehicle 6 is the direction toward the road 7*d*, based on the second predicted path information. For example, the controller 50 makes the second tentative determination in the affirmative when determining that the direction indicator 65 in the left end portion in the front portion of the vehicle 6 exhibits the emission color as described above.

Next in Step ST93, the controller 50 determines whether to have made at least one of the first tentative determination and the second tentative determination in the affirmative. When having made at least one of the first tentative determination and the second tentative determination in the affirmative, the controller 50 determines that the traveling direction of the vehicle 6 is the direction toward the road 7*d* in Step ST94. When having made the first tentative determination and the second tentative determination in the negative, the controller 50 determines that the traveling direction of the vehicle 6 is not the direction toward the road 7*d* in Step ST95.

As described above, when having made at least one of the first tentative determination and the second tentative determination in the affirmative, the controller 50 determines that the traveling direction of the vehicle 6 is the direction toward the road 7*d*. Thus, when the height of this vehicle 6 is larger than the reference value, the controller 50 transmits the warning information to the vehicle 6.

Thus, for example, even in the case where the driver attempts to travel to the road 7*d* off the route guided by the navigation device 67, when the direction indicators 65 indicate the travel to the road 7*d*, the controller 50 of the roadside unit 5 transmits the warning information to the vehicle 6. Conversely, in the case where the driver drives the vehicle 6 according to the route information containing the road 7*d*, even when the driver forgets to operate the direction indicators 65, the controller 50 transmits the warning information to the vehicle 6. Thus, the controller 50 can transmit the warning information more appropriately.

Three or more types of the predicted path information may be adopted as the predicted path information. In other words, the controller 50 may determine that the traveling direction of the vehicle 6 is the direction toward the road 7*d* when having made, in the affirmative, at least one of tentative determinations on the traveling direction based on a plurality of pieces of the predicted path information.

In the aforementioned example, the roadside unit 5 makes determinations on both of the height and the traveling direction of the vehicle 6. However, the roadside unit 5 may transmit the warning information based on the determination on the vehicle height, and the vehicle 6 receiving the warning information may make the determination on the traveling direction. In other words, the controller 60 of the vehicle 6 may obtain the predicted path information, and determine whether the traveling direction of the vehicle 6 coincides with the direction toward the road 7*d*, based on this predicted path information.

For example, the controller 60 of the vehicle 6 can obtain, as the predicted path information, the indicator information indicating a state of the direction indicators 65. For example, the sensor 68 may detect the state of the direction indicators 65, and output, to the controller 60, the detection result as the indicator information. Alternatively, an operation signal indicating an operation performed on the operators 66 may be output to the controller 60 as the indicator information.

Figure 18:
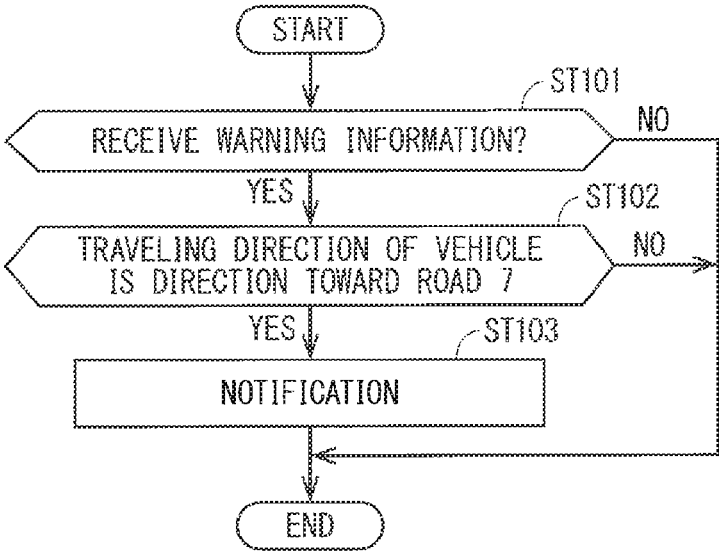
FIG. 18 illustrates a flowchart showing one example of the operations of the vehicle.

FIG. 18 illustrates a flowchart showing one example of the operations of the vehicle 6. A series of these processes is executed, for example, at predetermined time intervals. In Step ST101, the controller 60 determines whether the warning information has been received from the roadside unit 5 through the wireless communication unit 61. When determining the reception of the warning information, the controller 60 determines whether the traveling direction of the vehicle 6 is the direction toward the road 7*d*, based on the predicted path information (e.g., the indicator information) in Step ST102. When determining that the traveling direction of the vehicle 6 is the direction toward the road 7*d*, the controller 60 causes the notifier 63 to notify the warning information in Step ST103. When making a negative determination in Step ST101 or ST102, the controller 60 ends the processes.

As described above, the controller 60 does not notify the warning information when the vehicle 6 does not proceed to the road 7*d* even upon receipt of the warning information, and notifies the warning information when the vehicle 6 proceeds to the road 7*d*. Consequently, the controller 60 can notify the warning information appropriately. In other words, the controller 60 can restrain or avoid an unnecessary notification.

Besides the indicator information, the route information generated by the navigation device 67 and the wheel information detected by the sensor 68 may be adopted as the predicted path information.

A plurality of different pieces of the predicted path information may be adopted. Here, the controller 60 may make a tentative determination on the traveling direction for each of the plurality of the predicted path information, and notify the warning information when determining, in at least one of these tentative determinations, that the traveling direction of the vehicle 6 is the direction toward the road 7*d*.

The controller 60 may perform the process of controlling the driving mechanism 64 so that the controller 60 restricts the vehicle 6 from traveling to the road 7*d* as described above, as a replacement for this notification process or together with the notification process. Specifically, the processes from Steps ST22 to Step ST24 in FIG. 7 may be executed as a replacement for the process of Step ST103 or together with this process.

In the aforementioned example, the vehicle height is described as the size of the vehicle 6. Furthermore, the road 7*d* may have a restriction on the width of a vehicle. For example, the vehicle 6 wider than the road 7*d* cannot pass through the road 7*d*. Thus, the roadside units 5 and the vehicles 6 may perform the similar operations on the vehicle width.

Specifically, the sensor 52 of the roadside unit 5 may be able to detect the width of the vehicle 6 and output, to the controller 50, the detected value as vehicle width information. The sensor 52 may comprise, for example, a depth image sensor. The depth image sensor can generate a three-dimensional image. The sensor 52 performs image analysis on the three-dimensional image to identify the vehicle 6. The association between a width of one pixel in the width direction of the vehicle 6 in the three-dimensional image and a width in the actual width direction is preset. The sensor 52 detects the width of the vehicle 6 in the three-dimensional image (per pixel), and finds the width of the vehicle 6 based on the association.

The controller 50 determines whether the width of the vehicle 6 detected by the sensor 52 is larger than a reference value. This reference value is set based on a restriction value on the vehicle width of the road 7*d*. When determining that the vehicle width is larger than the reference value, the controller 50 transmits the warning information to the vehicle 6.

Other Examples

The sensor 52 need not be contained in a casing of the roadside unit 5. The sensor 52 may be installed at, for example, a position different from that in the casing. Here, the roadside unit 5 excluding the sensor 52 may be regarded as a master roadside unit, and the sensor 52 may be regarded as a slave roadside unit. The master roadside unit and the slave roadside unit are installed at different positions near the intersection 2. The master roadside unit and the slave roadside unit may communicate with each other, for example, via wires or wirelessly.

As described above, while a roadside unit, a vehicle, a transport system, a method for controlling the roadside unit, a method for controlling the vehicle, and a control program are described in detail, the foregoing description is in all aspects illustrative and does not restrict this disclosure. The various modifications described above are applicable in combination unless any contradiction occurs. It is understood that numerous modifications that have not yet been exemplified can be devised without departing from the scope of this disclosure.

The invention claimed is:

1. A roadside unit installed in a traffic network comprising a first road on which a vehicle larger than a reference value is permitted to travel, and a second road on which travel of the vehicle larger than the reference value is restricted, the second road being connected to the first road, the roadside unit comprising:

a first communication unit configured to wirelessly communicate with the vehicle; and a first controller configured to: (i) obtain size information indicating a size of the vehicle; (ii) determine, based on the size information, whether the size is larger than the reference value; and (iii) transmit predetermined information to the vehicle through the first communication unit when determining that the size is larger than the reference value.

2. The roadside unit according to claim 1, wherein the first controller obtains predicted path information indicating a traveling direction of the vehicle, and the first controller transmits the predetermined information when determining that the size is larger than the reference value, based on the size information and determining that the traveling direction is a direction toward the second road, based on the predicted path information.

3. The roadside unit according to claim 2, wherein the first road comprises a first lane and a second lane, the first lane is a lane in which travel from the first road to the second road is permitted, the second lane is a lane in which the travel from the first road to the second road is prohibited, and the first controller obtains, as the predicted path information, position information indicating a position of the vehicle, and the first controller determines that the traveling direction is the direction toward the second road when determining, based on the position information, that the first lane covers the position.

4. The roadside unit according to claim 3, comprising a sensor configured to detect the predicted path information.

5. The roadside unit according to claim 2, wherein the vehicle comprises a direction indicator advertising the traveling direction, and the first controller obtains, as the predicted path information, indicator information indicating a state of the direction indicator, and the first controller determines that the traveling direction is the direction toward the second road when determining, based on the indicator information, that the direction indicator indicates travel to the second road.

6. The roadside unit according to claim 2, wherein the first controller receives the predicted path information from the vehicle through the first communication unit.

7. The roadside unit according to claim 2, wherein the vehicle transmits route information indicating a planned path, and the first controller determines that the traveling direction is the direction toward the second road when determining that the route information received through the first communication unit contains the second road.

8. The roadside unit according to claim 2, wherein the first controller obtains a plurality of different types of the predicted path information, the first controller makes a tentative determination on whether the traveling direction is the direction toward the second road for each of the plurality of the predicted path information, and the first controller determines that the traveling direction is the direction toward the second road when making any one of the tentative determinations in the affirmative.

9. The roadside unit according to claim 1, comprising a sensor configured to detect, for each vehicle, first distinguishing information for distinguishing the vehicle and the size information in association with each other, wherein the first controller transmits the predetermined information using the first distinguishing information corresponding to the size information when determining, based on the size information, that the size is larger than the reference value.

10. The roadside unit according to claim 9, wherein the first distinguishing information contains information indicating a vehicle model, a vehicle registration plate, or a position of the vehicle.

11. The roadside unit according to claim 9, wherein the first controller performs an encryption process on the predetermined information using the first distinguishing information as an encryption key, and the first controller transmits the encrypted predetermined information.

12. The roadside unit according to claim 9, wherein the first controller receives second distinguishing information for distinguishing between a plurality of vehicles, from each of the plurality of vehicles through the first communication unit, the first controller sets communication information between the roadside unit and each of the plurality of vehicles in association with the second distinguishing information, the communication information being address information or a communication channel, the first controller associates the communication information and the size information of a same vehicle in association with each other, based on the first distinguishing information and the second distinguishing information that correspond to each other, and the first controller transmits the predetermined information using the communication information corresponding to the size information when determining, based on the size information, that the size is larger than the reference value.

13. The roadside unit according to claim 9, wherein the first controller receives second distinguishing information for distinguishing between a plurality of vehicles, from each of the plurality of vehicles through the first communication unit, the first controller sets an encryption key between each of the plurality of vehicles and the roadside unit in association with the second distinguishing information, the first controller associates the encryption key and the size information of a same vehicle in association with each other, based on the first distinguishing information and the second distinguishing information that correspond to each other, the first controller performs an encryption process on the predetermined information using the encryption key corresponding to the size information when determining, based on the size information, that the size is larger than the reference value, and the first controller transmits the encrypted predetermined information.

14. A vehicle, comprising:

a second communication unit configured to communicate with the roadside unit according to claim 1;

a notifier configured to make a notification to a driver; and a second controller configured to cause the notifier to perform a process of making the notification upon receipt of the predetermined information from the roadside unit through the second communication unit.

15. The vehicle according to claim 14, wherein the second controller obtains predicted path information indicating a traveling direction of the vehicle, upon receipt of the predetermined information, the second controller determines whether the traveling direction is the direction toward the second road, based on the predicted path information, and the second controller performs the process when determining that the traveling direction is the direction toward the second road.

16. A vehicle, comprising:

a second communication unit configured to communicate with the roadside unit according to claim 1;

a driving mechanism; and a second controller configured to perform a process of controlling the driving mechanism so that the second controller restricts the vehicle from traveling to the second road upon receipt of the predetermined information from the roadside unit through the second communication unit.

* * * * *